US006774743B2

(12) United States Patent
De Lillo et al.

(10) Patent No.: US 6,774,743 B2
(45) **Date of Patent: *Aug. 10, 2004**

(54) MULTI-LAYERED SPIRAL COUPLERS ON A FLUROPOLYMER COMPOSITE SUBSTRATE

(75) Inventors: Rocco A. De Lillo, New Rochelle, NY (US); Joseph McAndrew, Wharton, NJ (US)

(73) Assignee: Merrimac Industries, Inc., West Caldwell, NJ (US)

( * ) Notice: Subject to any disclaimer, the term of this patent is extended or adjusted under 35 U.S.C. 154(b) by 31 days.

This patent is subject to a terminal disclaimer.

(21) Appl. No.: 10/114,711

(22) Filed: Apr. 1, 2002

(65) Prior Publication Data

US 2002/0175775 A1 Nov. 28, 2002

Related U.S. Application Data

(63) Continuation-in-part of application No. 09/711,118, filed on Nov. 9, 2000.

(51) Int. Cl.[7] ..... H01P 5/18
(52) U.S. Cl. ..... 333/116; 333/118
(58) Field of Search ..... 333/116, 112, 333/118

(56) References Cited

U.S. PATENT DOCUMENTS

| | | | | |
|---|---|---|---|---|
| 5,065,122 A | * | 11/1991 | Juskey et al. | 333/238 |
| 5,073,814 A | | 12/1991 | Cole, Jr. et al. | |
| 5,369,379 A | * | 11/1994 | Fujiki | 333/116 |
| 5,598,327 A | | 1/1997 | Somerville et al. | 336/200 |
| 5,612,660 A | | 3/1997 | Takimoto | 336/200 |
| 6,169,320 B1 | | 1/2001 | Stacey | 257/531 |
| 6,170,154 B1 | | 1/2001 | Swarup | 29/830 |
| 6,218,015 B1 | | 4/2001 | Allen et al. | 428/422 |

* cited by examiner

*Primary Examiner*—Benny Lee
(74) *Attorney, Agent, or Firm*—James V. Mahon; Clifford Chance US LLP

(57) ABSTRACT

A microwave circuit utilizes a spiral-like coupler configuration to achieve the functionality of a traditional coupler with higher density and lower volume. A plurality of substrate layers having metal layers disposed on them are bonded to form the package. A plurality of groundplanes may be used to isolate the spiral-like shape from lines extending out to contact pads or other circuitry.

12 Claims, 37 Drawing Sheets

3000

△ = logical positional reference
✿ symbols (not part of structure)

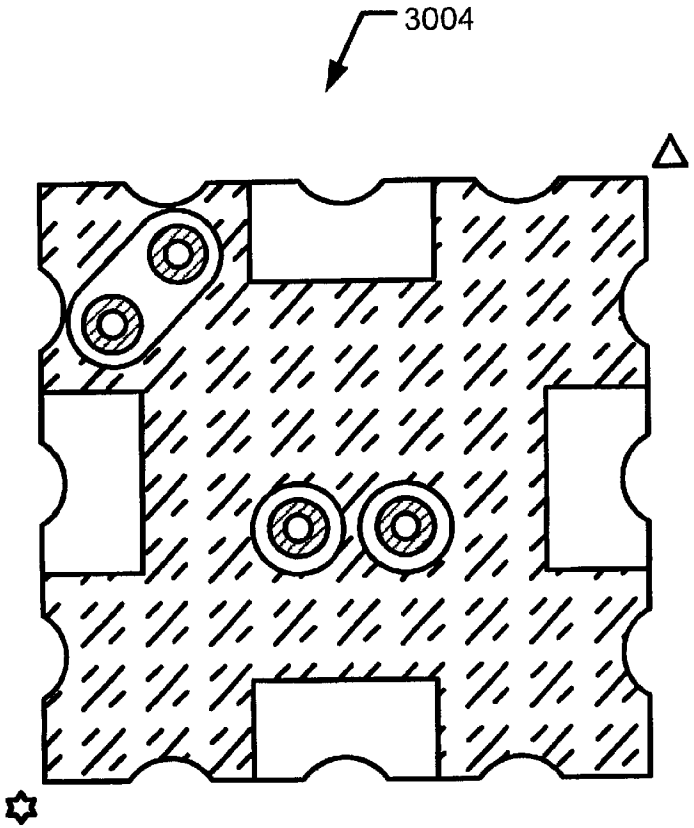
Fig. 37
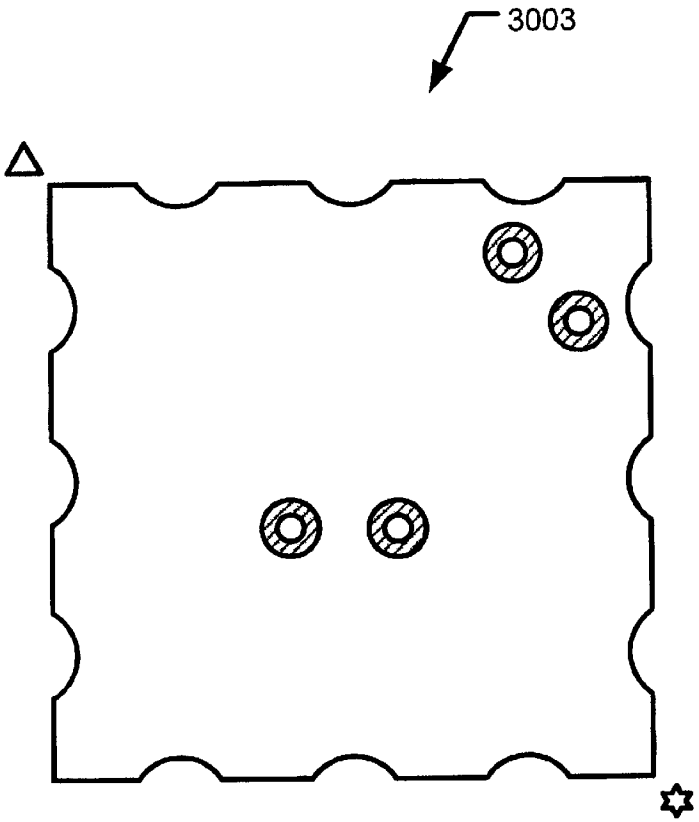
Fig. 36
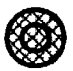
= Conductive pad

MULTI-LAYERED SPIRAL COUPLERS ON A FLUROPOLYMER COMPOSITE SUBSTRATE

CROSS-REFERENCE(S) TO RELATED APPLICATIONS

This application claims the benefit of the filing date of, and is a continuation-in-part of, co-pending U.S. patent application Ser. No. 09/711,118, entitled "Spiral Couplers" filed on Nov. 9, 2000.

FIELD OF THE INVENTION

This invention relates to microwave couplers. More particularly, this invention discloses the topology of and a method for manufacturing couplers that typically operate at microwave frequencies and utilize spiral-like configurations to achieve high density and low volume.

BACKGROUND OF THE INVENTION

Over the decades, wireless communication systems have become more and more technologically advanced, with performance increasing in terms of smaller size, operation at higher frequencies and the accompanying increase in bandwidth, lower power consumption for a given power output, and robustness, among other factors. The trend toward better communication systems puts ever-greater demands on the manufacturers of these systems.

Today, the demands of satellite, military, and other cutting-edge digital communication systems are being met with microwave technology, which typically operates at frequencies from approximately 500 MHz to approximately 60 GHz or higher. Many of these systems use couplers, such as directional couplers, in their microwave circuitry.

Traditional couplers, especially those that operate at lower frequencies, typically require a relatively long parts housing size (i.e., a long packaging size) since coupling between lines is often required over a long distance.

Popular technologies for microwave technologies include low temperature co-fired ceramic (LTCC), ceramic/polyamide (CP), epoxy fiberglass (FR4), fluoropolymer composites (PTFE), and mixed dielectric (MDk, a combination of FR4 and PTFE). Each technology has its strengths, but no current technology addresses all of the challenges of designing and manufacturing microwave circuits.

For example, multilayer printed circuit boards using FR4, PTFE, or MDk technologies are often used to route signals to components that are mounted on the surface by way of soldered connections of conductive polymers. For these circuits, resistors can be screen-printed or etched, and may be buried. These technologies can form multifunction modules (MCM) which carry monolithic microwave integrated circuits (MMICs) and can be mounted on a motherboard.

Although FR4 has low costs associated with it and is easy to machine, it is typically not suited for microwave frequencies, due to a high loss tangent and a high correlation between the material's dielectric constant and temperature. There is also a tendency to have coefficient of thermal expansion (CTE) differentials that cause mismatches in an assembly. Even though recent developments in FR4 boards have improved electrical properties, the thermoset films used to bond the layers may limit the types of via hole connections between layers.

Another popular technology is CP, which involves the application of very thin layers of polyamide dielectric and gold metalization onto a ceramic bottom layer containing MMICs. This technology may produce circuitry an order of magnitude smaller than FR4, PTFE, or MDk, and usually works quite well at high microwave frequencies. Semiconductors may be covered with a layer of polyamide. However, design cycles are usually relatively long and costly. Also, CTE differentials often cause mismatches with some mating assemblies.

Finally, LTCC technology, which forms multilayer structures by combining layers of ceramic and gold metalization, also works well at high microwave frequencies. However, as with CP technology, design cycles are usually relatively long and costly, and CTE differentials often cause mismatches with some mating assemblies. Advances in LTCC technology, including reduction of design cycles and LTE differentials may make this technology better suited for spiral-like couplers in the future.

Advances have been made in reducing the size of LTCC couplers and FR4 couplers, by using strip-line spiral-like configurations. Examples of spiral-like configurations for couplers using various technologies may be found in U.S. Pat. No. 3,999,150 to Caragliano et al., U.S. Pat. No. 5,689,217 to Gu et al., U.S. Pat. No. 6,170,154 to Swarup and U.S. Pat. No. 5,841,328 to Hayashi, all incorporated herein by reference. However, using spiral-like configurations for couplers based on these technologies have certain limitations, as described below.

Hard ceramic materials may provide dielectric constants higher than approximately 10.2, but components utilizing these materials cannot be miniaturized in a stand-alone multilayer realization. For example, bond wire interconnects must be used for the realization of microstrip circuitry, increasing the overall size of the resulting microwave devices. Other ceramic materials have limited dielectric constants, typically approximately 2 to 4, which prevent close placement of metalized structures and tend to be unreliable for small, tight-fitting components operating at microwave frequencies. Additionally, ceramic devices operating at microwave frequencies may be sensitive to manufacturing limitations and affect yields. LTCC Green Tape materials tend to shrink during processing, causing mismatches preventing manufacturers from making smaller coupling lines and placing coupling lines too closely to each other such that they lose their spacing due to shifting during processing. For these reasons, spiral-like configurations of couplers cannot be too compact and the benefits of using spirals are limited under the currently available processing methods for the materials.

Note that FR4 materials have other disadvantages. For example, FR4 materials have a limited range of dielectric constants, typically approximately 4.3 to 5.0, preventing manufacturers from placing metalized lines too compactly. Manufacturers utilizing this material also cannot avail themselves of the advantage of fusion bonding. Additionally, FR4 materials are limited in the tolerance of copper cladding that they can sustain—typically 1.4 mils is the minimum thickness, so the dimensional tolerances are limited. As with ceramics, spiral-like configurations of couplers cannot be too compact, and the benefits of using spirals are limited for FR4. MDk materials also have similar disadvantages to FR4.

Note that PTFE composite is a better technology than FR4, ceramics, and MDk for spiral-like couplers. Fluoropolymer composites having glass and ceramic often have exceptional thermal stability. They also allow copper cladding thickness below approximately 1.4 mils, which permits tighter control of etching tolerances. Additionally, these materials have a broad range of dielectric constants—typically approximately 2.2 to 10.2. Also, they can handle more power than most other material. All these features allow spiral-like couplers to be built much more compactly on PTFE than is possible using other types of material. Furthermore, complex microwave circuits can be fabricated using PTFE technology and the application of fusion bonding allows homogeneous multilayer assemblies to be formed.

SUMMARY OF THE INVENTION

The present invention relates to spiral-like couplers and the manufacture of spiral-like couplers using PTFE as a base material, Coupling lines are wound in spiral-like shapes, which can be rectangular, oval, circular, or other shape that provides a compact structure in nature. Couplers can consist of two, three, or more coupling lines, depending on the application and desired coupling. Coupling lines can be co-planar, taking up only one layer of metalization between two layers of dielectric material, or they can be stacked in two or more layers (i.e., layers 140, 150, 160, 170 of FIG. 2*a*), depending upon the number of lines being utilized.

It is an object of this invention to provide spiral-like couplers that utilize PTFE technology.

It is another object of this invention to provide spiral-like couplers that have smaller cross sectional dimensions than traditional couplers.

It is another object of this invention to provide spiral-like couplers that have improved electrical characteristics.

It is another object of this invention to provide spiral-like couplers that maximize space utilization along the Z-axis.

It is another object of this invention to provide spiral-like couplers that maximize space utilization in three dimensions.

It is another object of this invention to provide spiral-like couplers that can be fusion bonded.

BRIEF DESCRIPTION OF THE DRAWINGS

FIG. 36 shows conductive pads on, and conductive vias through, surface 3003.

FIG. 37 shows conductive pads on, metalization of, and conductive vias through surface 3004.

Like reference labels in different drawing figures refer to the same feature which may not be described in detail for all drawing figures.

DETAILED DESCRIPTION OF THE INVENTION

Three Coupling Line Configurations

Figure 1:
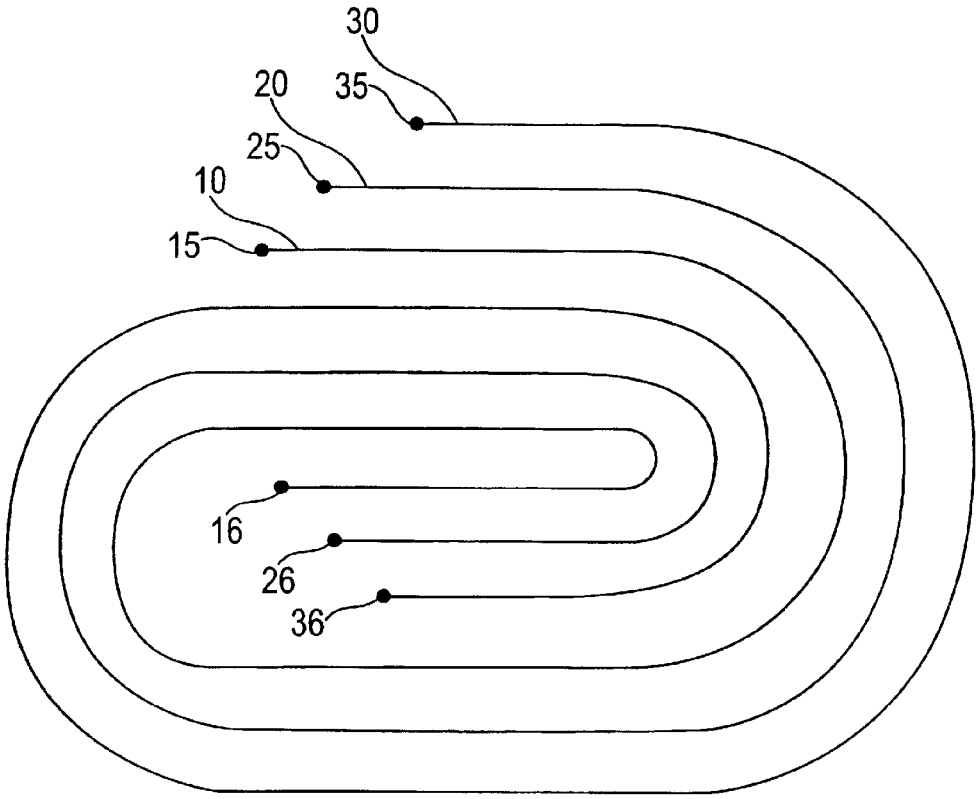
FIG. 1 is the top view of an oval-shaped spiral-like coupler having three coupling lines in one plane.

Referring to FIG. 1, a spiral-like coupler is shown. Coupling lines 10, 20, 30 are wound in a configuration to provide coupling among three pathways for microwave signals. In a preferred embodiment, coupling lines 10, 20, 30 have oval configurations. In alternative preferred embodiments, rectangular shapes and round shapes may be used. In other alternative embodiments, the shape of the coupler may depend on space considerations. For example, it is possible for a microwave circuit having several components to be configured most efficiently by utilizing a spiral-like coupler that is substantially L-shaped or U-shaped, by way of example only.

Coupling line 10 is connected to other parts of the circuit through via holes 15, 16 which are preferably situated at the ends of coupling line 10. Similarly, via holes 25, 26 provide connections for coupling line 20 and via holes 35, 36 provide connections for coupling line 30.

Although the coupler shown in FIG. 1 has three coupling lines, it is obvious to those of ordinary skill in the art of coupling lines that one can use spiral-like configurations for couplers having more than three coupling lines, or only two coupling lines.

Figure 2A:
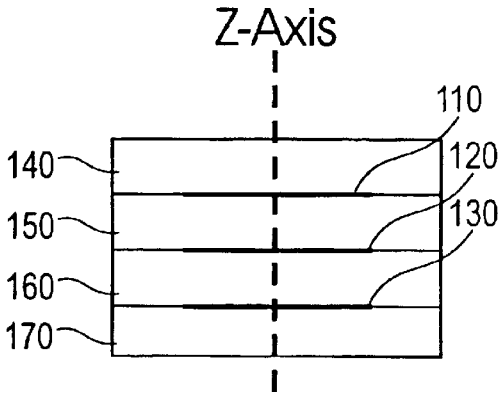
FIG. 2*a* is a side view of an oval-shaped spiral-like coupler having three coupling lines in three planes.
Figure 2B:
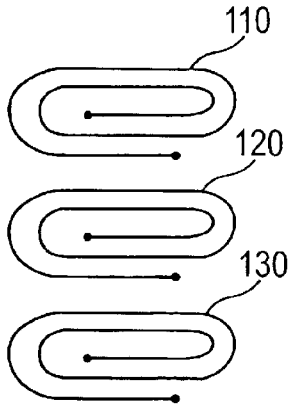
FIG. 2*b* is an exploded perspective view of the oval-shaped spiral-like coupler shown in FIG. 2*a*.

Referring to FIGS. 2*a* and 2*b*, a spiral-like coupler having coupling lines distributed along the Z-axis (i.e., existing on different levels) is shown. Coupling lines 110, 120, 130 are wound in a configuration to provide coupling among three pathways for microwave signals. In a preferred embodiment, coupling lines 110, 120, 130 have oval configurations and are of the same size and shape. In alternative preferred embodiments, rectangular shapes and round shapes may be used. In other alternative embodiments, the shape of the coupler may depend on space considerations.

Although the coupler shown in FIGS. 2*a* and 2*b* has three coupling lines, it is obvious to those of ordinary skill in the art of coupling lines that one can use spiral-like configurations for couplers having more than three coupling lines, or only two coupling lines.

Example of a Preferred Embodiment of a Spiral Coupler

Figure 3:
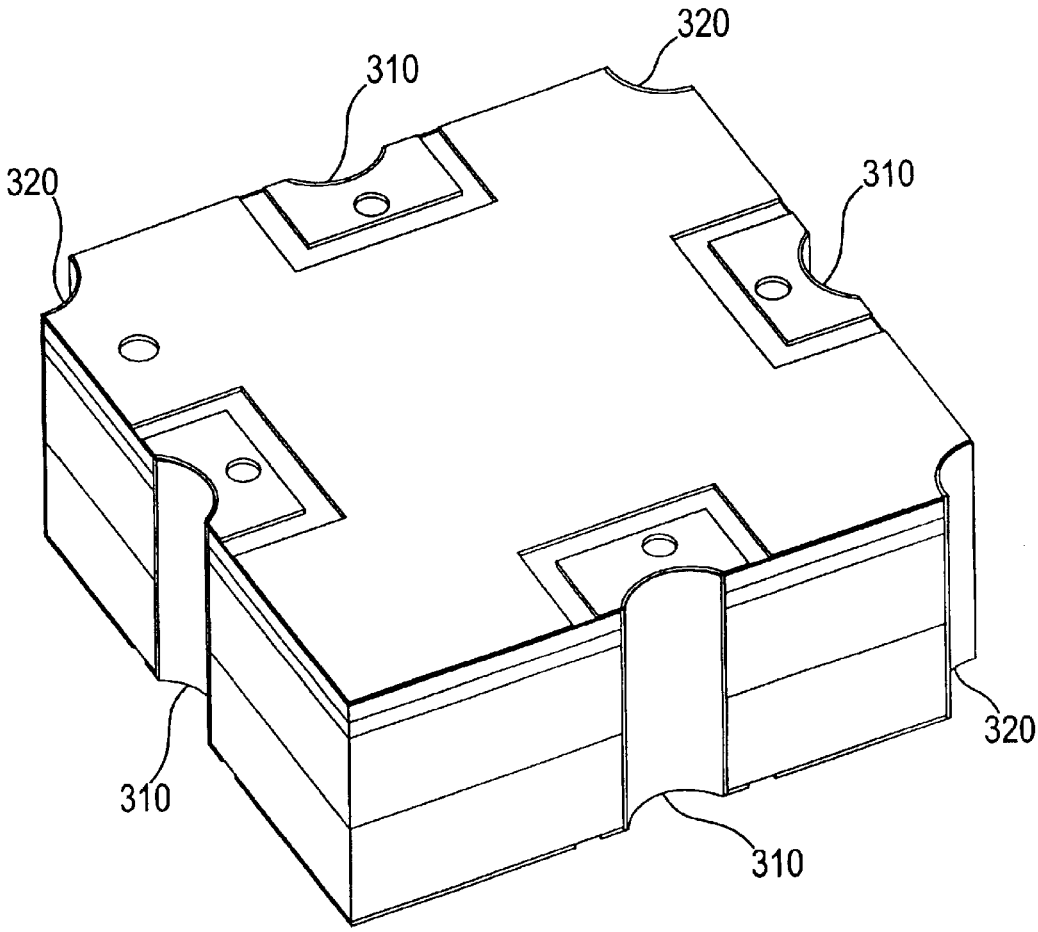
FIG. 3 is a perspective view of an example of a spiral coupler package.
Figure 4:
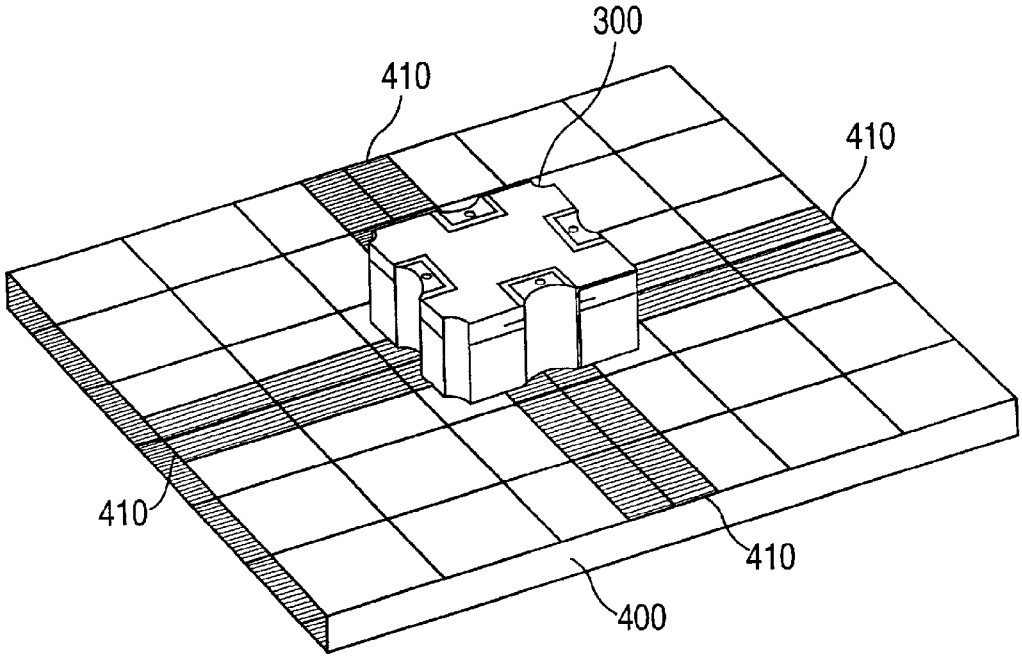
FIG. 4 is a perspective view of the spiral coupler package of FIG. 3 mounted on a board.

Referring to FIG. 3, an example of a spiral coupler package 300 is shown. Spiral coupler package 300 also has four contact pads 310, which are side holes in a preferred embodiment, for mounting, and three ground pads 320. In a preferred embodiment, contact pads 310 are soldered or wire-bound to metal pins, which may be gold plated, for connection to other circuitry. In an alternative preferred embodiment, spiral coupler package 300 is mounted on test fixture or board 400, as shown in FIG. 4. Board 400 has metalized lines 410 for connection to other circuitry.

Figure 5B:
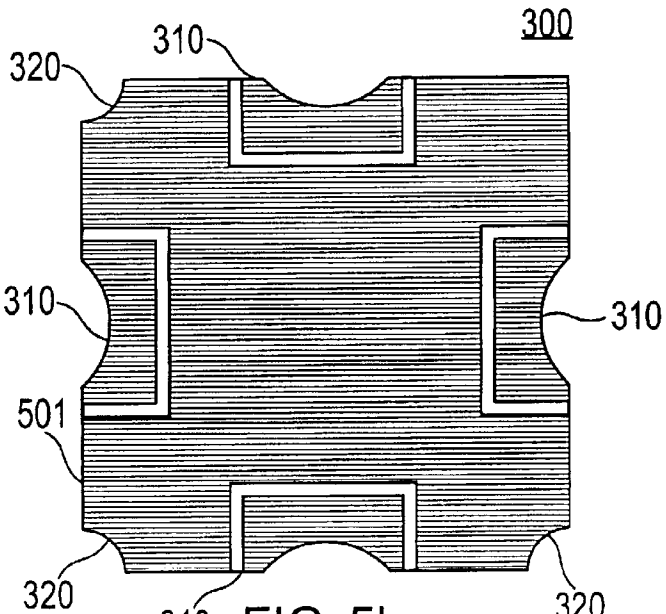
FIG. 5*b* is a bottom view of the spiral coupler package of FIG. 3.
Figure 5A:
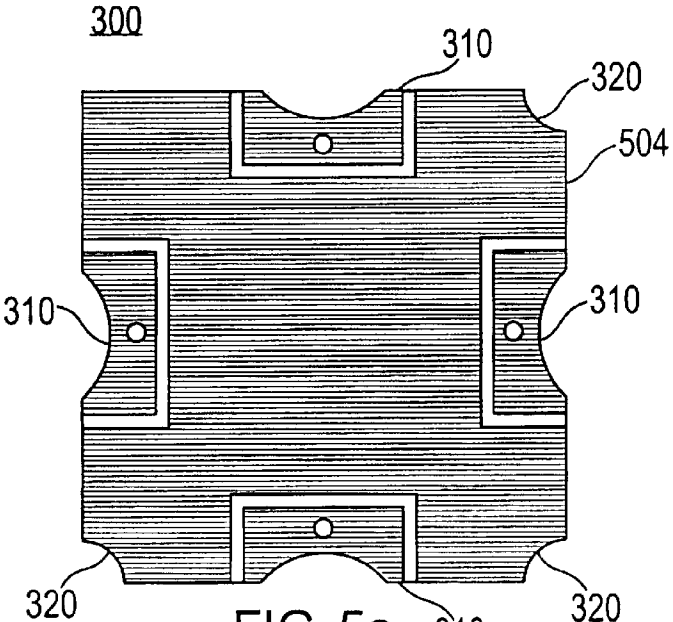
FIG. 5*a* is a top view of the spiral coupler package of FIG. 3.
Figure 5C:
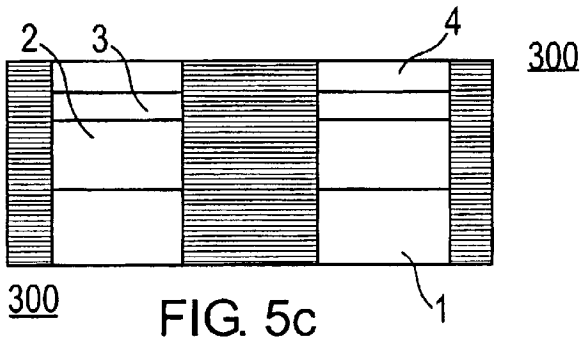
FIG. 5*c* is a side view of the spiral coupler package of FIG. 3.

FIGS. 5*a* and 5*b* show top and bottom views of spiral coupler package 300, respectively. FIG. 5*c* shows a side view of this embodiment, wherein spiral coupler package 300 consists of dielectric substrate layers 1, 2, 3, 4, which are approximately 0.175 inches square. Layers 1, 2 can be between approximately 0.025 and 0.036 inches thick and in a preferred embodiment is approximately 0.035 inches thick. Additionally, layers 1, 2 have dielectric constants of approximately 10.2. In a preferred embodiment the material used for layers 1, 2 is a PTFE material, such as RO-3010 high frequency circuit material manufactured by Rogers Corp., located in Chandler, Ariz. In another embodiment, glass based materials, ceramics or combinations of these materials can be used. Layers 3, 4 are approximately 0.005 inches thick and have dielectric constants of approximately 3.0. An example of material that can be used for layers 3, 4 is RO-3003 high frequency circuit material, also available from Rogers Corp. Additionally, glass based materials, ceramics or combinations of these materials can be used.

Figure 6:
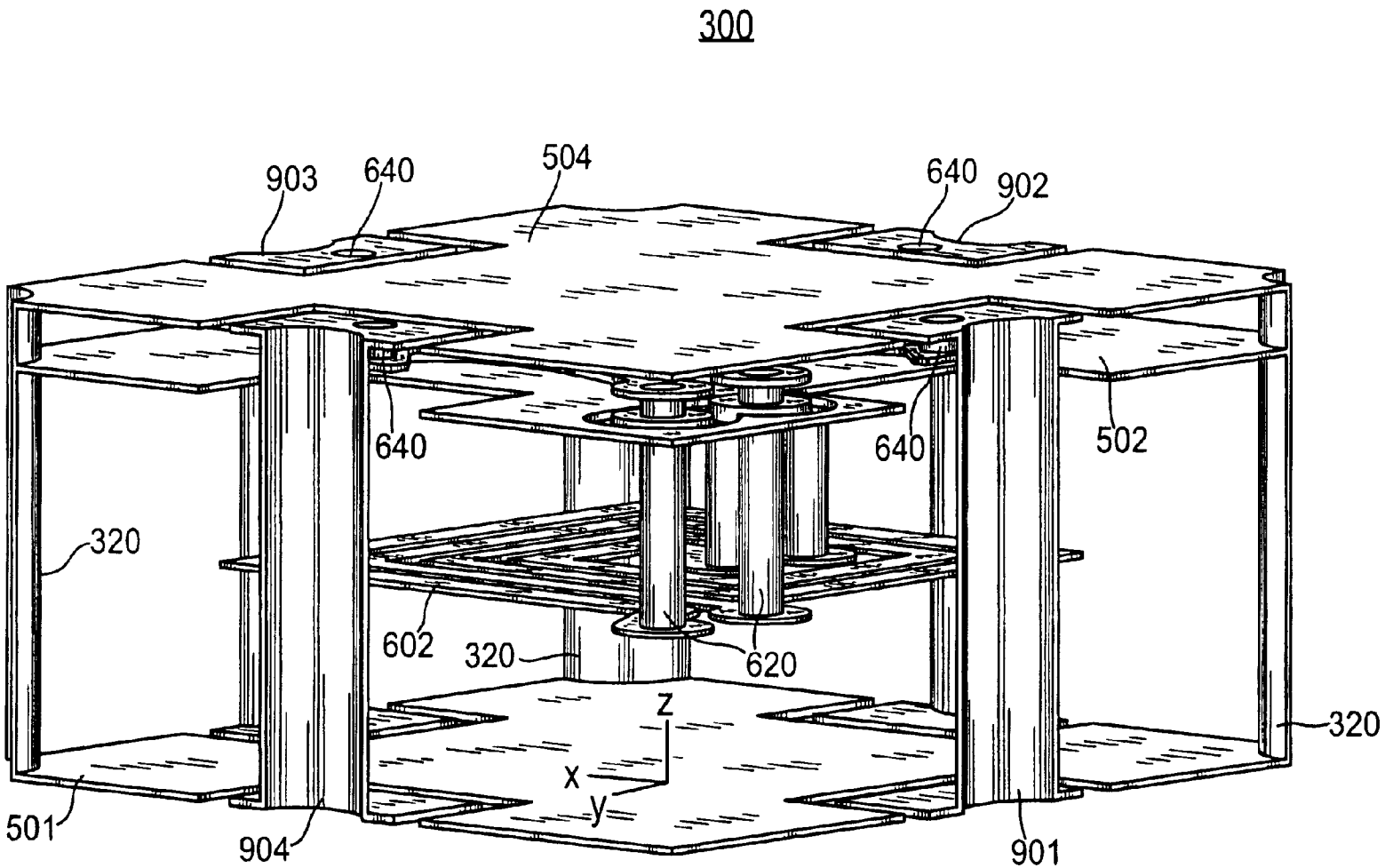
FIG. 6 is a perspective view of the metalization of the spiral coupler package of FIG. 3.

Metalization, preferably ½ ounce copper, is disposed on layers 1, 2, 3, 4 to provide some of the features of spiral coupler package 300. For example, the top of layer 4 is metalized with the pattern shown in FIG. 5*a* to define groundplane 504. Similarly, the bottom of layer 1 is metalized as shown in FIG. 5*b* to define groundplane 501. A third groundplane 502 disposed between layer 2 and layer 3 can be seen in FIG. 6, which shows only the metalization of spiral coupler package 300 without the supporting dielectric layers.

Thermal management considerations may effect the level of metalization used on layers 1, 2, 3, 4. Narrow circuit lines are known to have limited power capacity and a decreased ability to effectively transfer heat when compared to wider or thicker circuit lines. Therefore, heavier metalization can be applied to the mounting surface, interior layers, and selected vias to facilitate heat transfer and provide higher levels of thermal management.

Should the circuits be formed from lesser amounts of metalization, for cost savings or other reasons, thermal management may be accomplished through the addition of thermal conductors. Such thermal conductors may be formed on the same planar surface as the metalized layer. For example, additional circuit lines may be added to layers 1, 2, 3, 4 to facilitate thermal management. These thermal conductors may act individually, or in cooperation with thermal vias, i.e., cylinders running vertically through layers 1, 2, 3, 4. Such thermal conductors may be manufactured with metal or any other material, based upon the material's ability to transfer heat, and the design requirements of the coupler package 300. Preferably, such thermal conductors are manufactured from a material having improved thermal properties or lower cost, or both, than the metalized circuitry.

Figure 7:
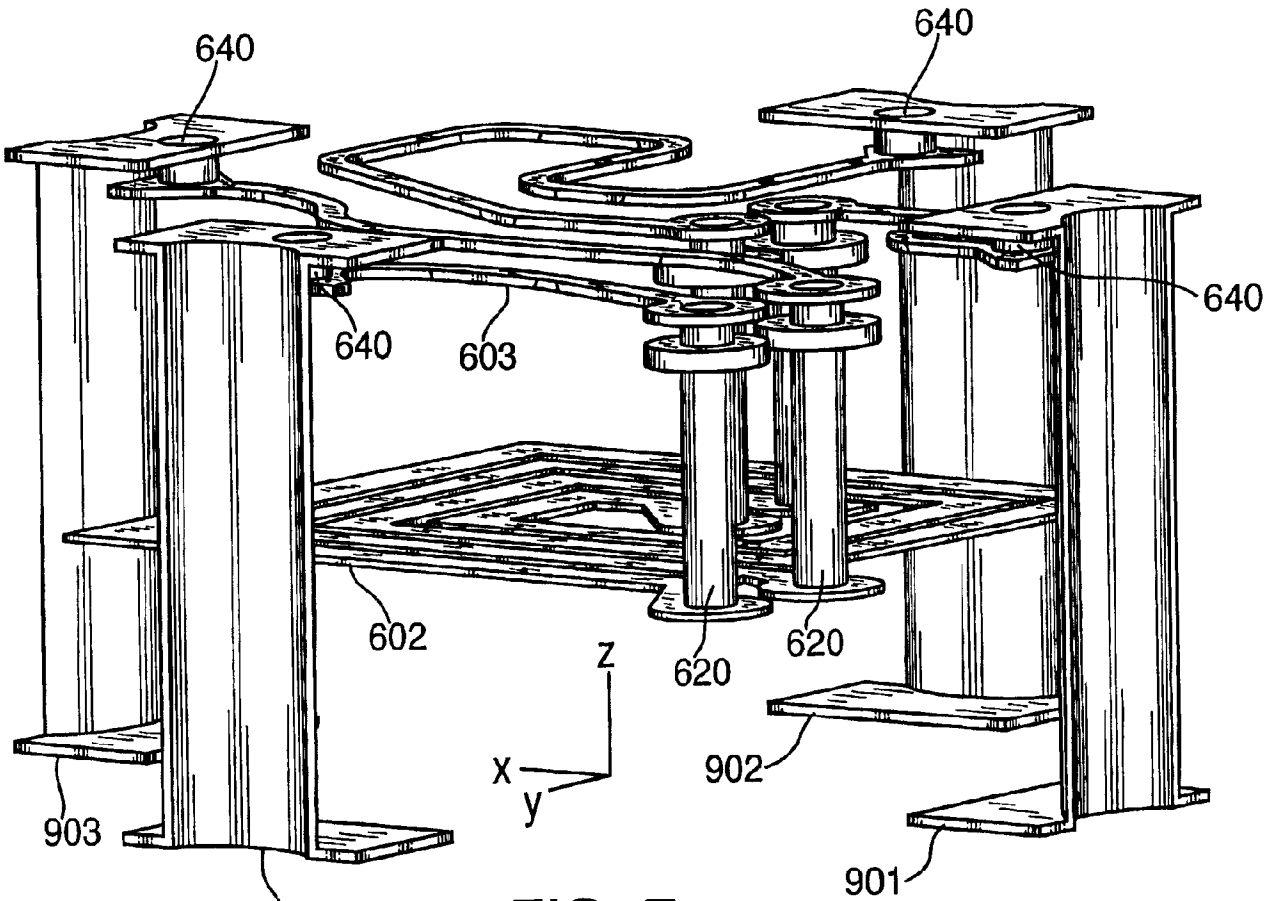
FIG. 7 is a perspective view of the metalization of FIG. 6, without the metalization used for ground.
Figure 8:
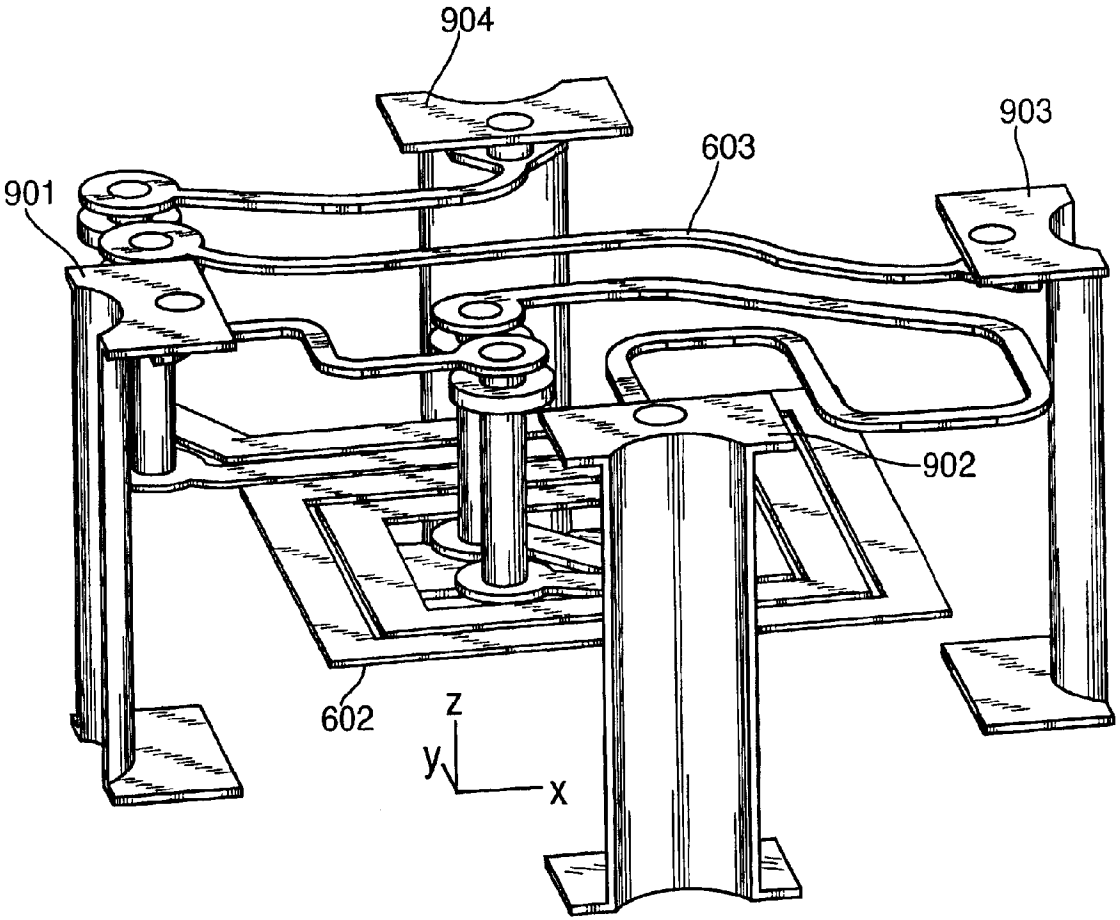
FIG. 8 is a rotated view of the metalization of FIG. 7.

Metalization layer 602 (FIG. 6) is disposed between layer 1 and layer 2, while metalization layer 603 (FIG. 7) is disposed between layer 3 and layer 4. In the preferred embodiment shown in FIG. 6, metalization layer 602 provides spiral-like shapes which are connected with via holes 620 to metalization layer 603 (FIG. 7), which provides pathways, through via holes 640 to contact pads 901, 902, 903, 904. FIG. 7 shows metalization layer 602, via holes 620, metalization layer 603, via holes 640 and contact pads 901, 902, 903, 904, without intervening groundplanes 501, 502, 504 of FIG. 6. FIG. 8 shows another view of the metalization shown in FIG. 7 (i.e., a view from a different angle and direction)

Figure 9:
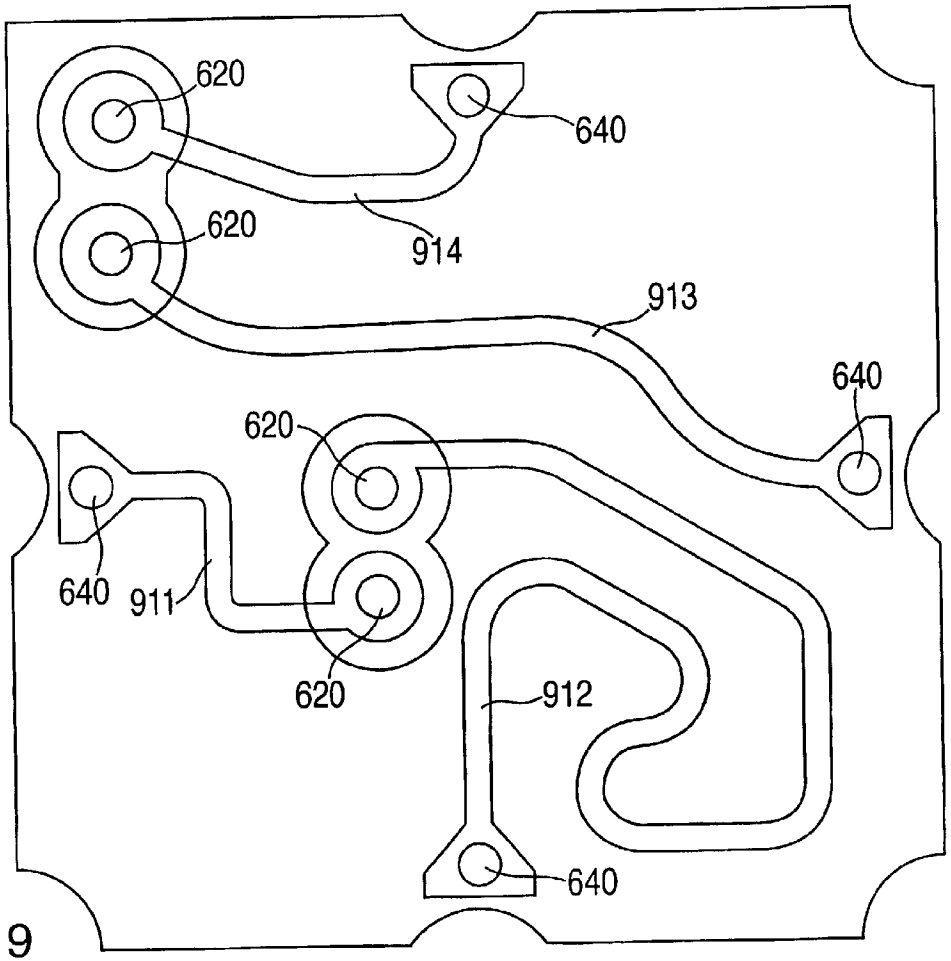
FIG. 9 is the top view of the placement of via holes and metal lines to contact pads for the circuit in the spiral coupler package of FIG. 3.
Figure 10:
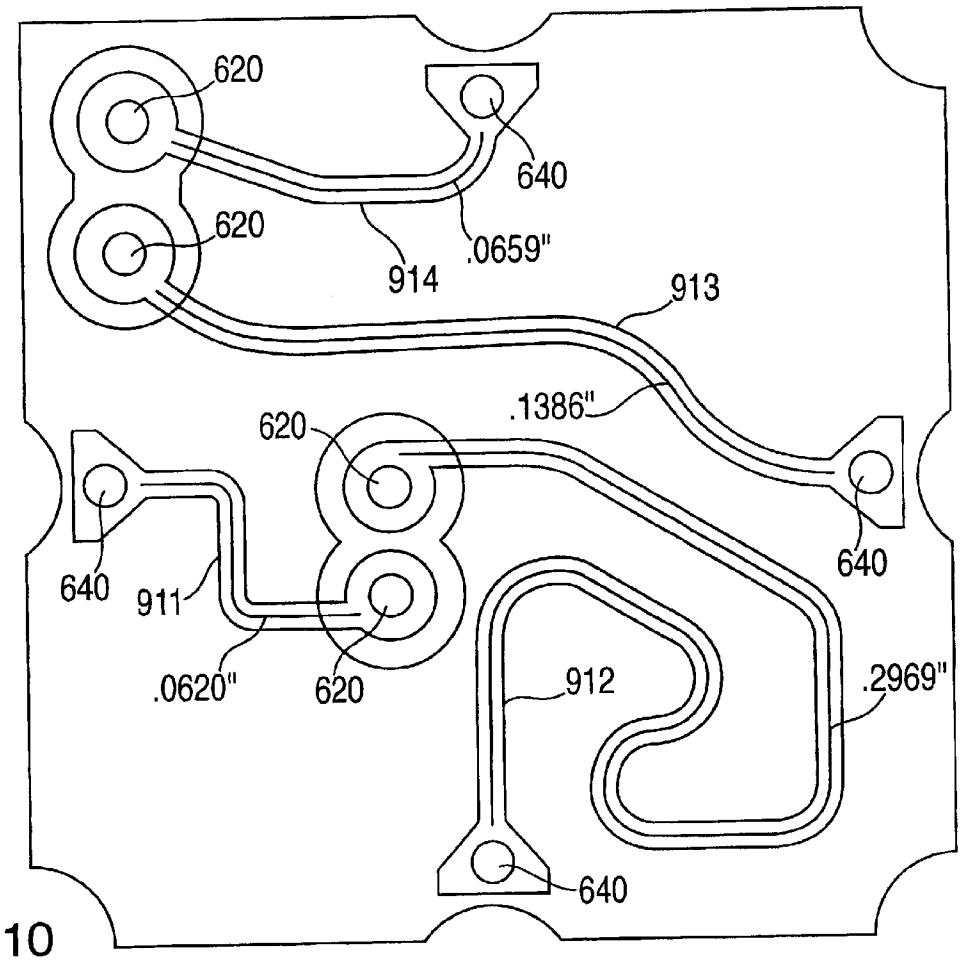
FIG. 10 is another top view of the placement of via holes and metal lines to contact pads for the circuit in the spiral coupler package of FIG. 3.

FIG. 9 shows the placement of via holes 620, which are connected to contact pads 901, 902, 903, 904 (FIGS. 6–8) by metal lines 911, 912, 913, 914 (FIGS. 6–8) respectively (which are part of metalization layer 603) and via holes 640. The widths and lengths of metal lines 911, 912, 913, 914 affect the performance of the coupler. In a preferred embodiment shown in FIG. 10, metal lines 911, 912, 913, 914 are between approximately 0.004 and 0.011 inches wide. Also, in the preferred embodiment of FIG. 10, the average length of metal line 911 is approximately 0.062 inches, line 912 is approximately 0.2969 inches, line 913 is approximately 0.1386 and line 914 is approximately 0.0659 inches.

Figure 11:
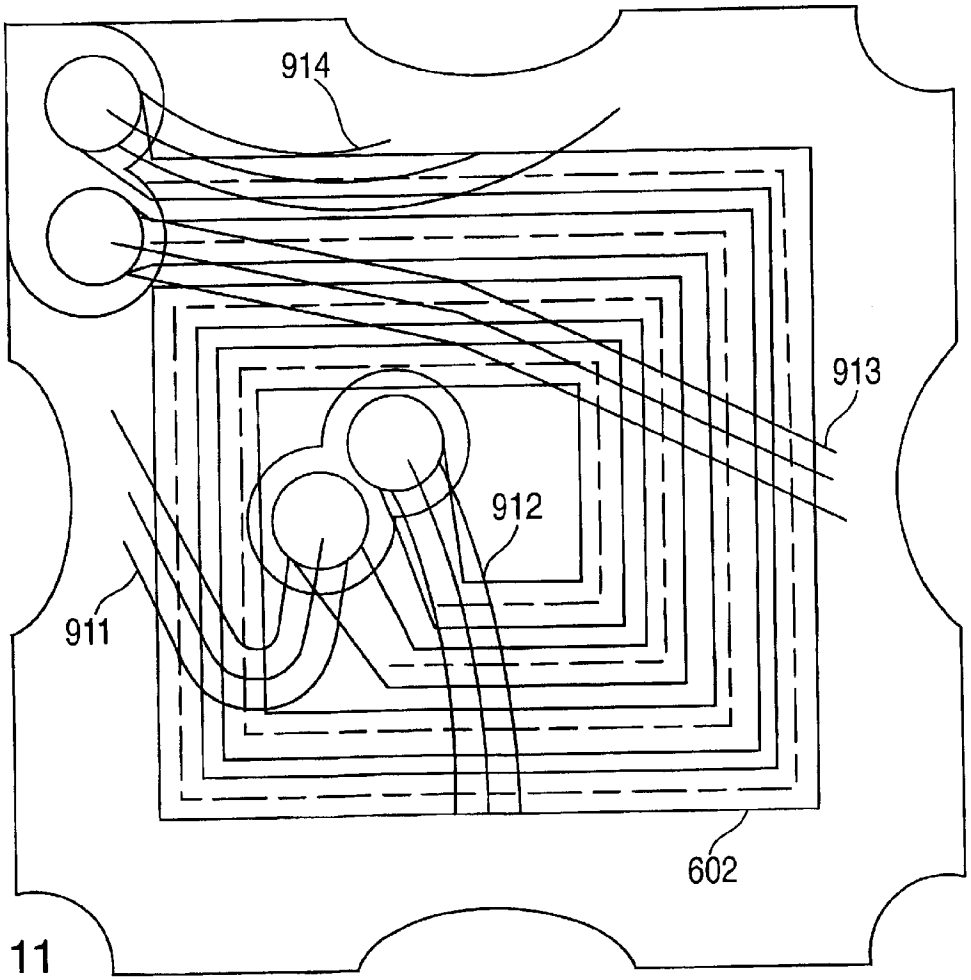
FIG. 11 is a superimposed view of a spiral-like coupler, via holes and metal lines to contact pads for the circuit in the spiral coupler package of FIG. 3.

Advantageously, groundplane 502 (FIG. 6) isolates metal lines 911, 912, 913, 914 from metalization layer 602. Without groundplane 502, it is apparent that signal cross-talk would occur between metalization layer 602 and metal lines 911, 912, 913, 914, which are shown superimposed in FIG. 11.

Figure 12:
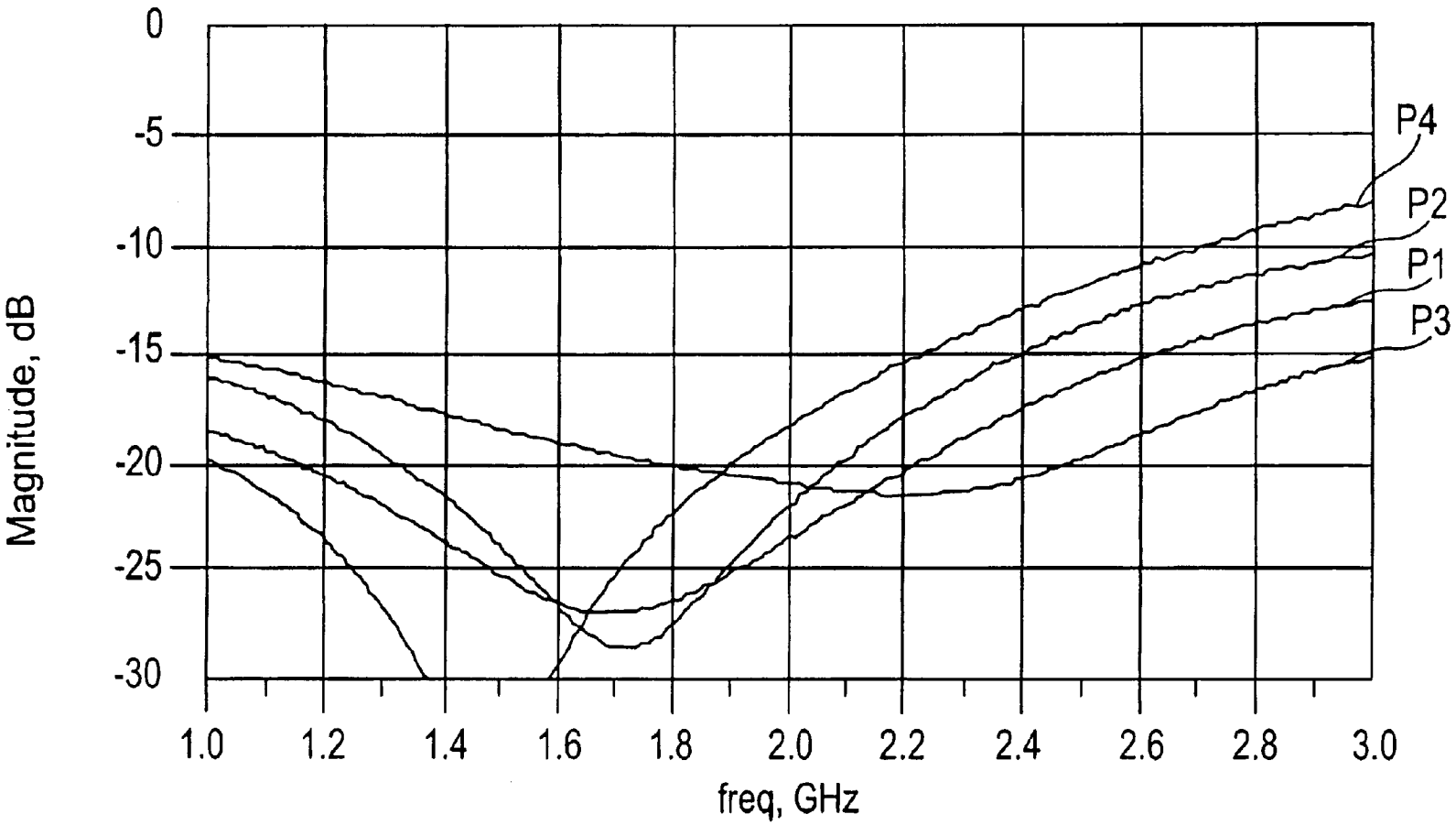
FIG. 12 is a plot of typical return loss characteristics for a preferred embodiment.
Figure 13:
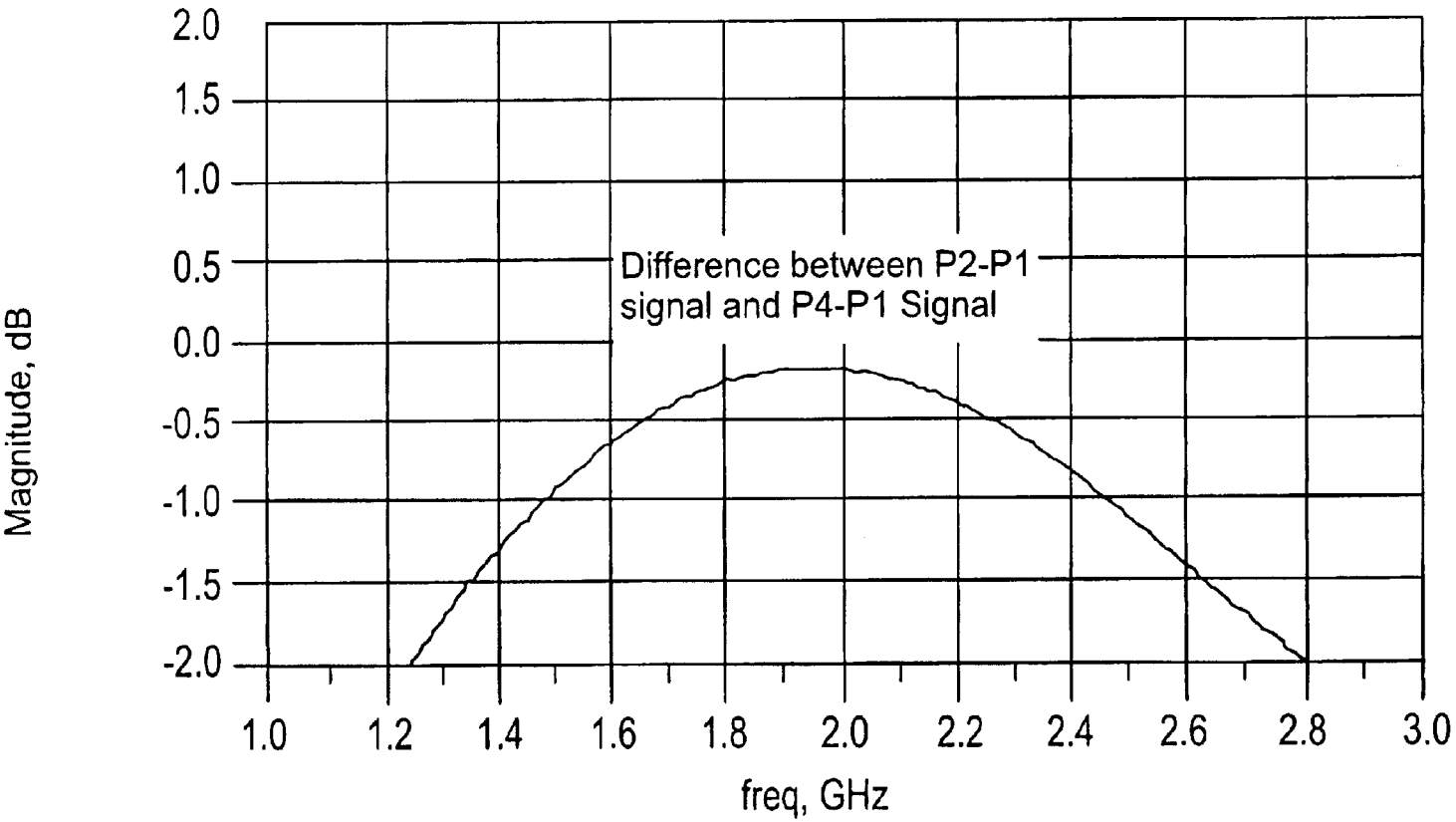
FIG. 13 is a plot of typical transmission amplitude balance characteristics for a preferred embodiment.
Figure 14:
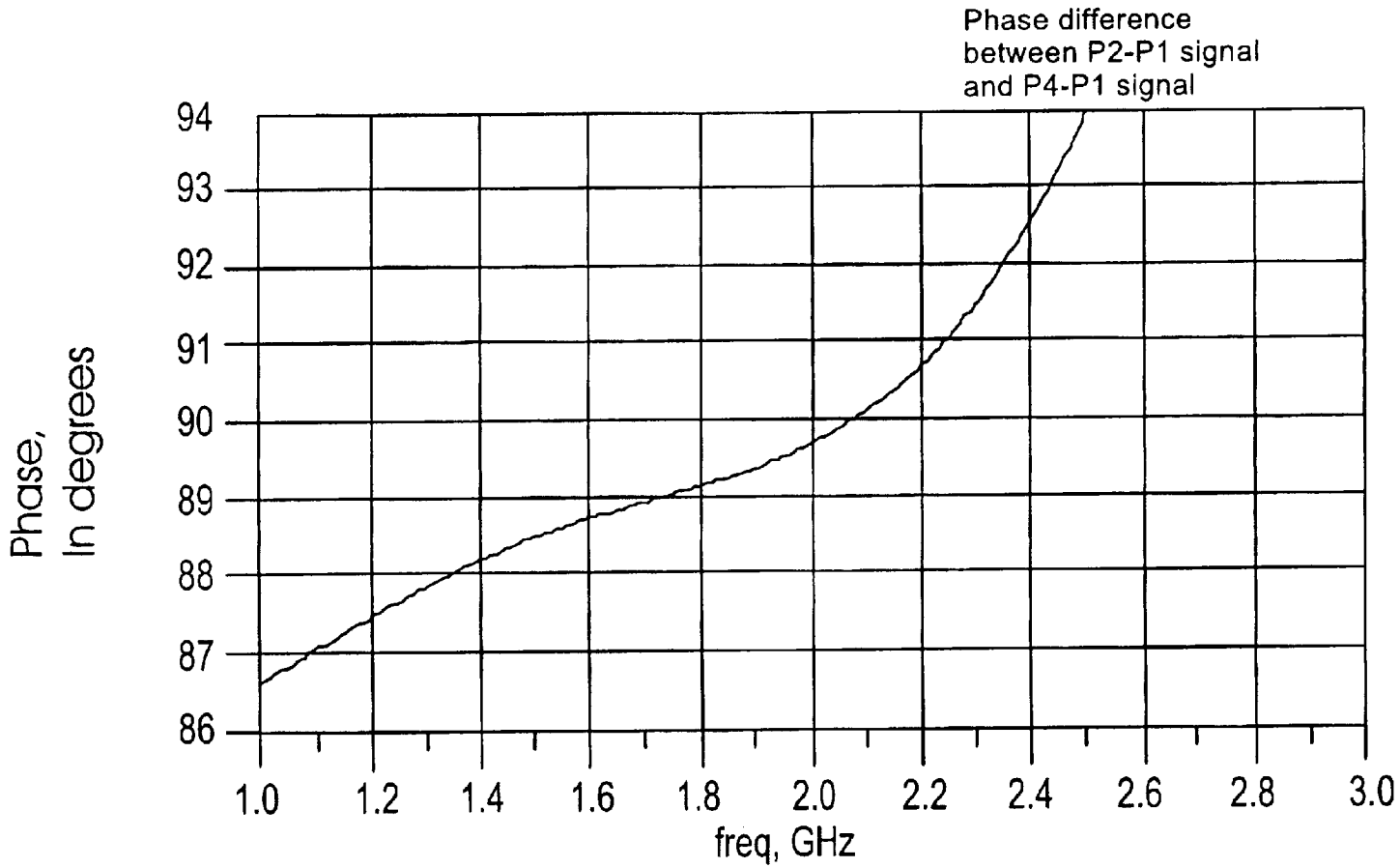
FIG. 14 is a plot of typical transmission phase balance characteristics for a preferred embodiment.
Figure 15:
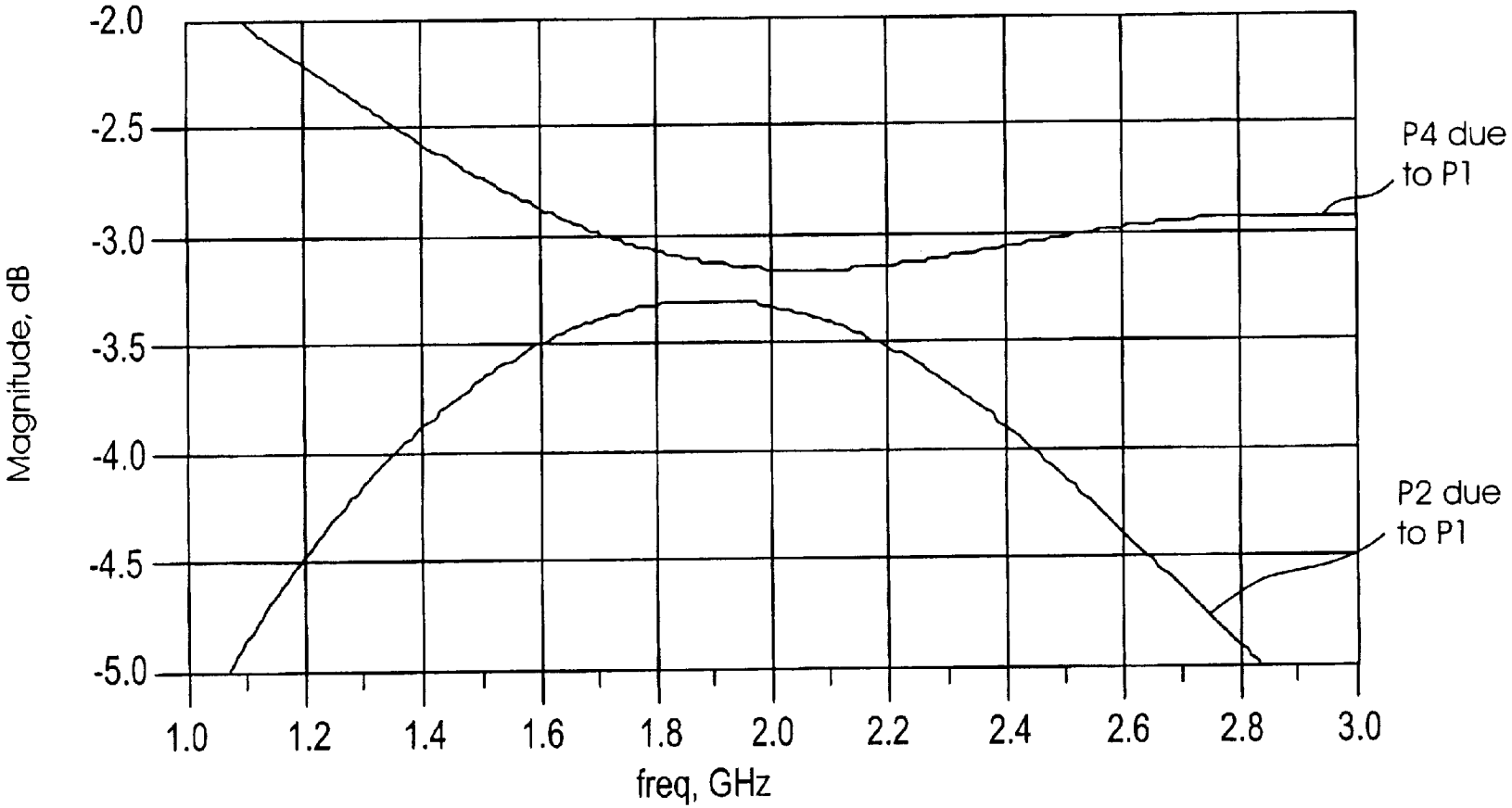
FIG. 15 is a plot of typical outer transmission characteristics for a preferred embodiment.
Figure 16:
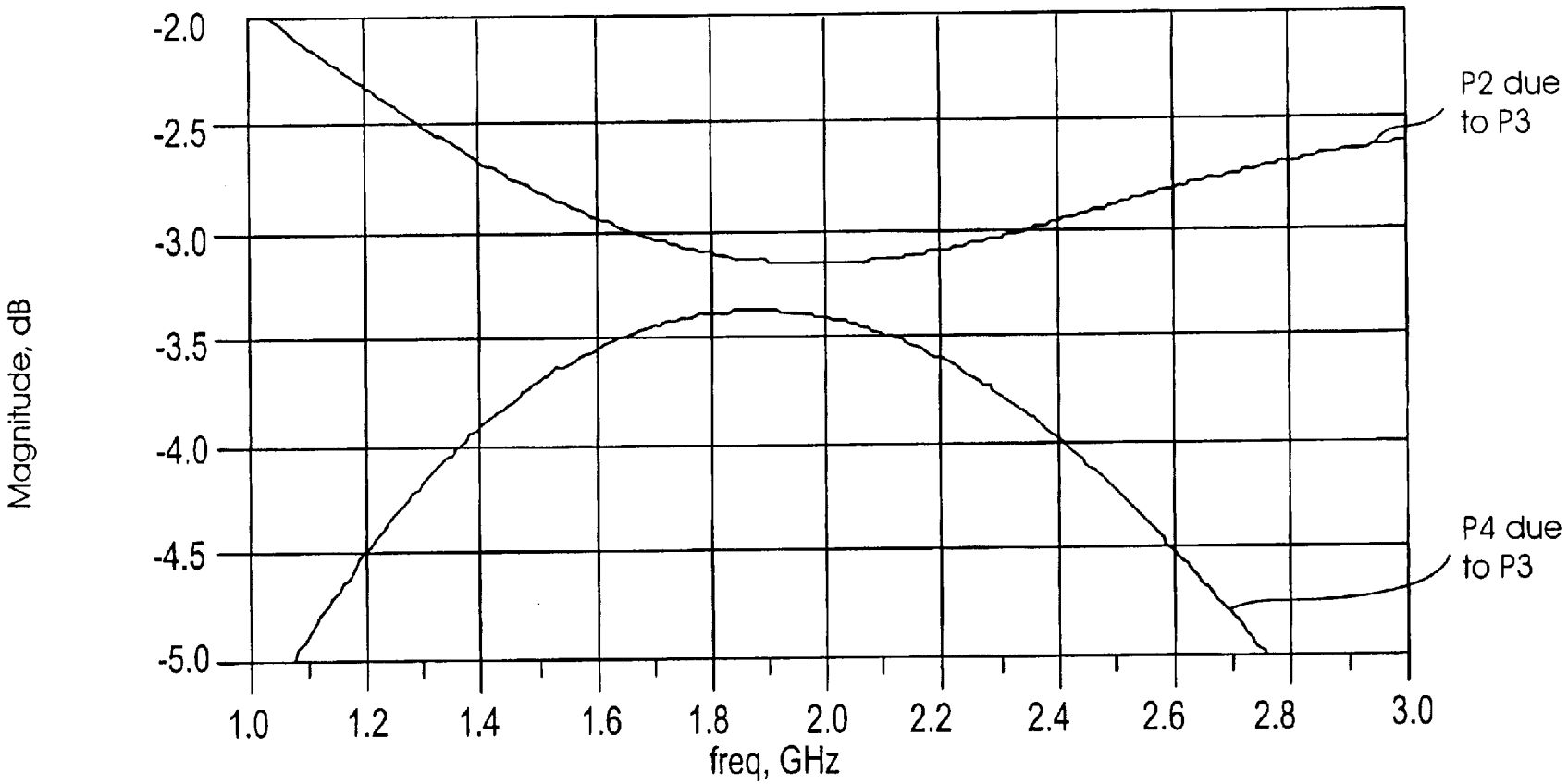
FIG. 16 is a plot of typical inner transmission characteristics for a preferred embodiment.
Figure 17:
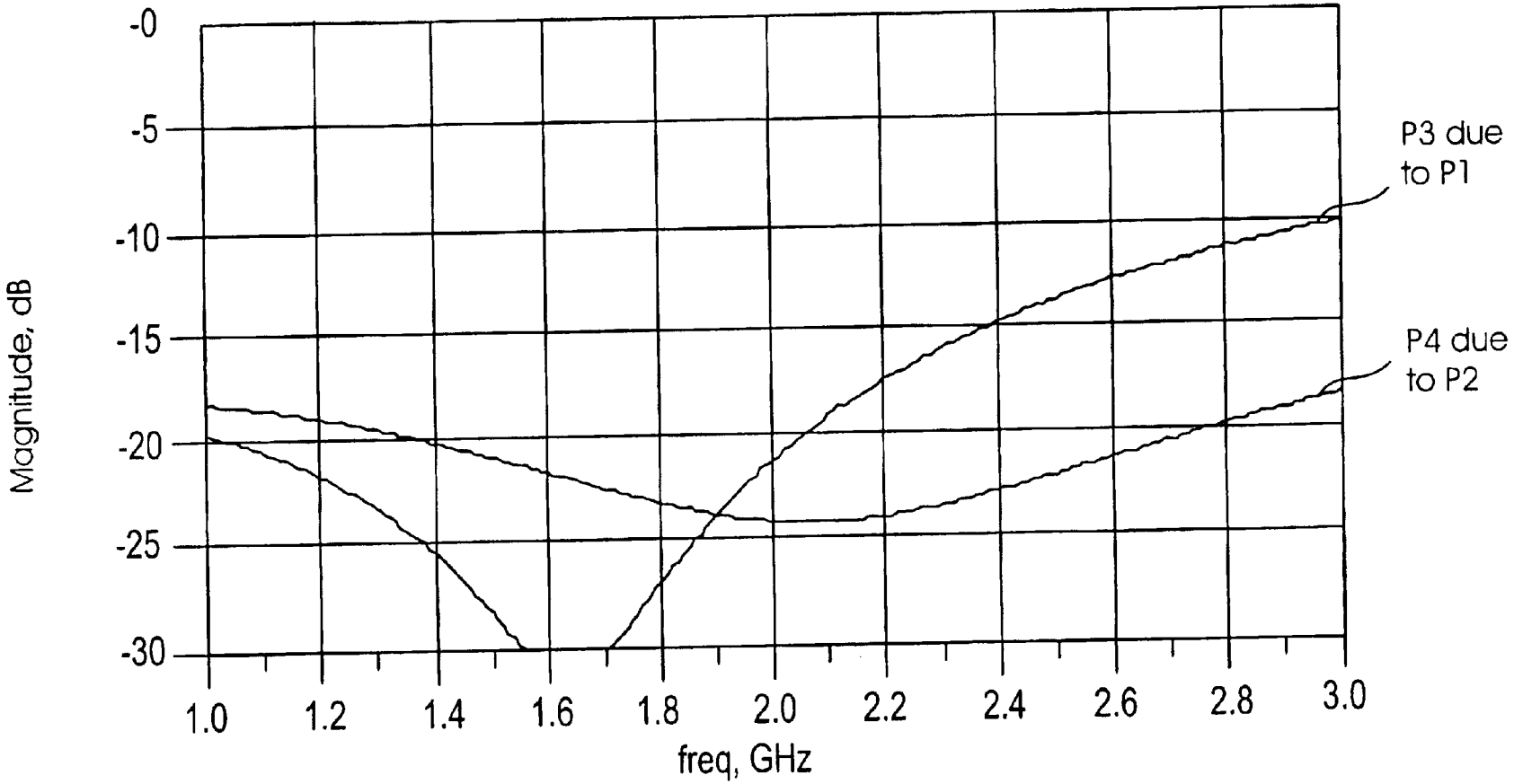
FIG. 17 is a plot of typical isolation characteristics for a preferred embodiment.

Referring to FIGS. 12–17, typical electrical performance characteristics of the embodiment shown in FIGS. 3–11 and described above are shown for a frequency range of 1.0 GHz to 3.0 GHz. For the purposes of the performance curves, four ports (P1, P2, P3, P4) are located as follows: P1 is at contact pad 901; P2 is at contact pad 902; P3 is at contact pad 903; and P4 is at contact pad 904. FIG. 12 shows the return loss, in decibels, for P1, P2, P3, and P4. FIG. 13 shows the amplitude balance, or difference between the signal from P2 to P1 and the signal from P4 to P1, in decibels. FIG. 14 shows the phase balance, or phase difference between the signal from P2 to P1 and the signal from P4 to P1, in degrees. FIG. 15 shows the outer transmission, in decibels, between P4 and P1 and between P2 and P1. FIG. 16 shows the inner transmission, in decibels, between P2 and P3 and between P4 and P3. FIG. 17 shows the isolation, in decibels, between P4 and P2 and between P3 and P1.

Figure 31:
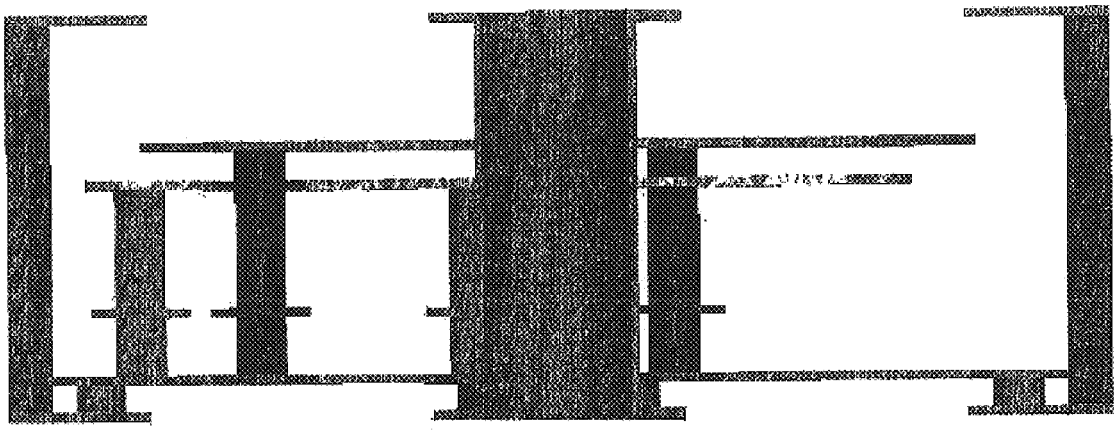
FIG. 31 is a perspective view of a coupler in accordance with FIG. 2*a* having two coupling lines in two planes, without metalization of ground planes.

Example of an Embodiment of a Spiral Coupler having Coupling Lines Distributed On the Z Axis FIGS. 31–43 show details of one embodiment of a spiral coupler package formed in accordance with FIG. 2*a*. Referring to FIG. 31, spiral coupler package 3000 also has contact pads and side holes similar to those of package 300 and may be mounted to a board in a similar fashion as for coupler package 300.

Figure 33:
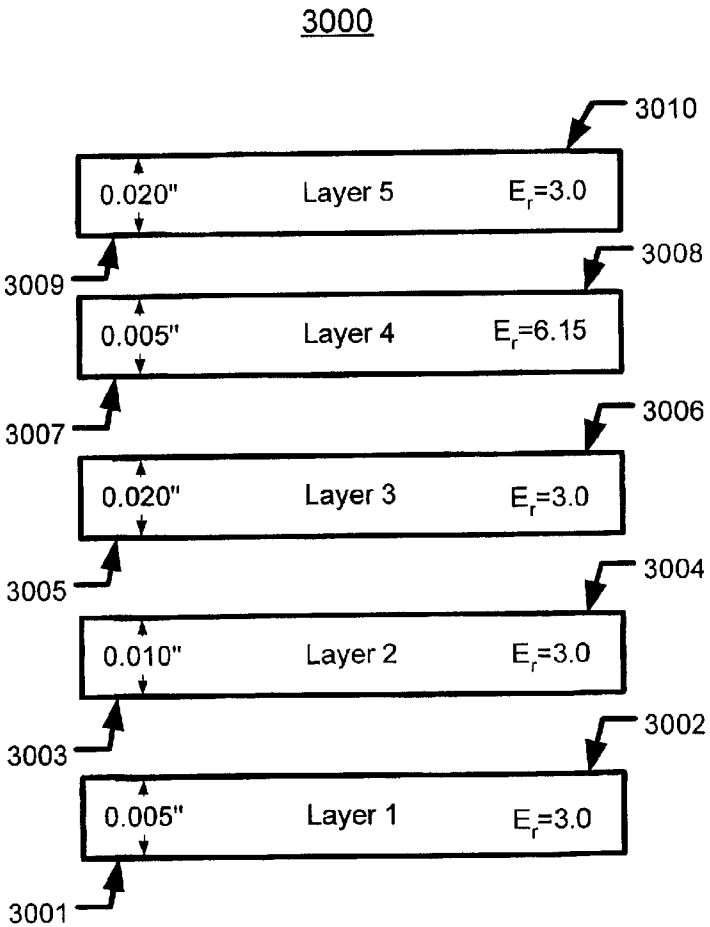
FIG. 33 shows an arrangement of five dielectric layers with surfaces 3001–3010 forming the coupler of FIG. 31.
Figure 32:
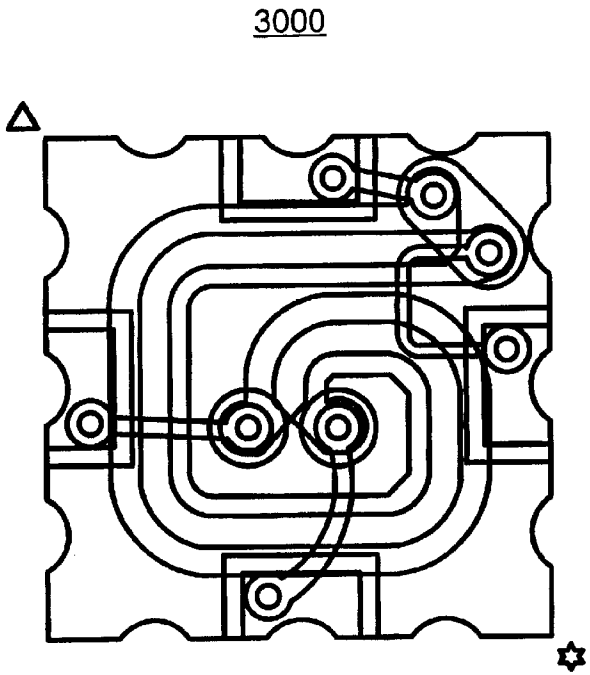
FIG. 32 shows a top-view of metalization of the spiral coupler of FIG. 31.
Figures 34, 35:
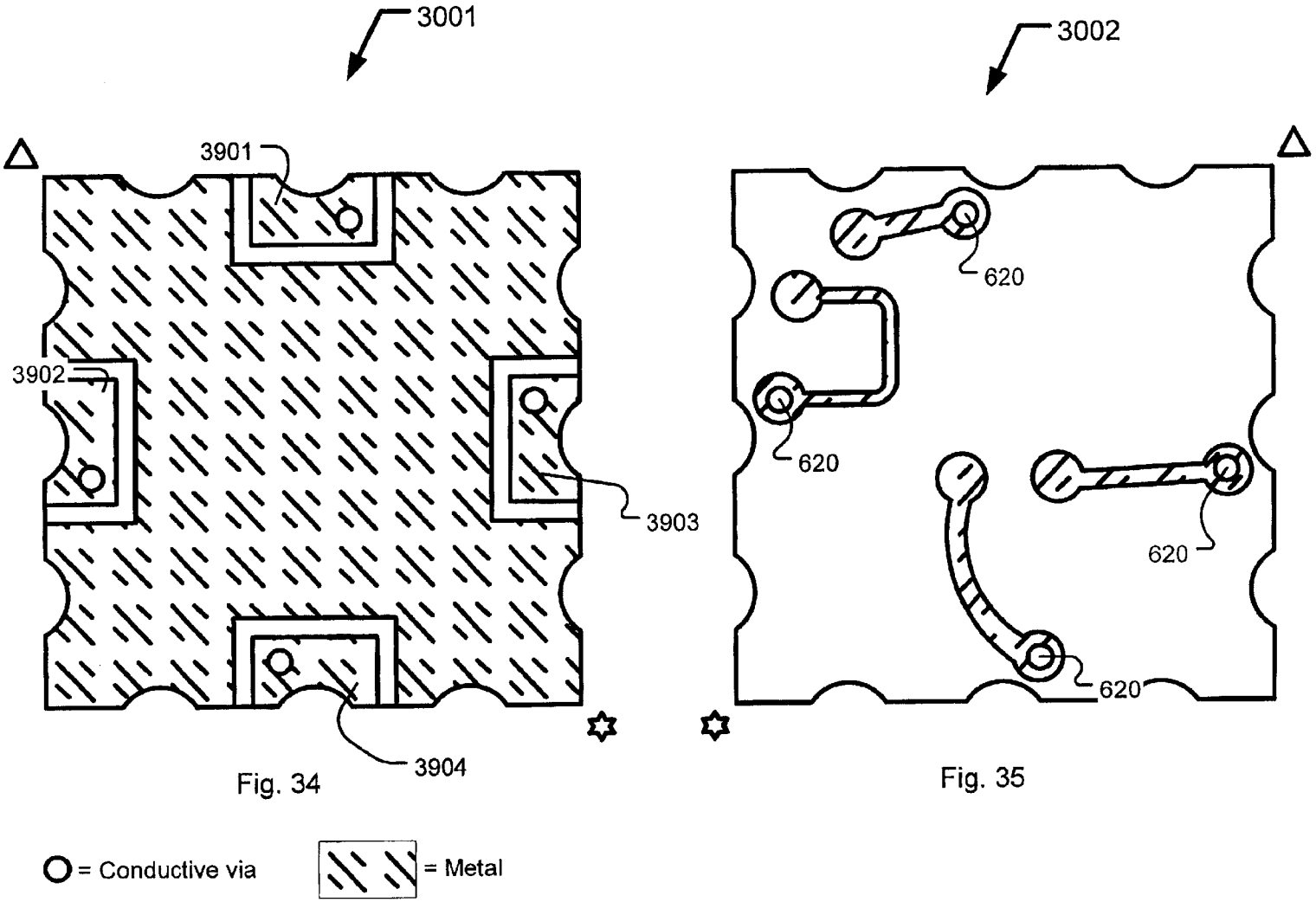
FIG. 34 shows metalization of, and conductive vias through, surface 3001.
FIG. 35 shows metalization of, and conductive vias through, surface 3002.
Figure 39:
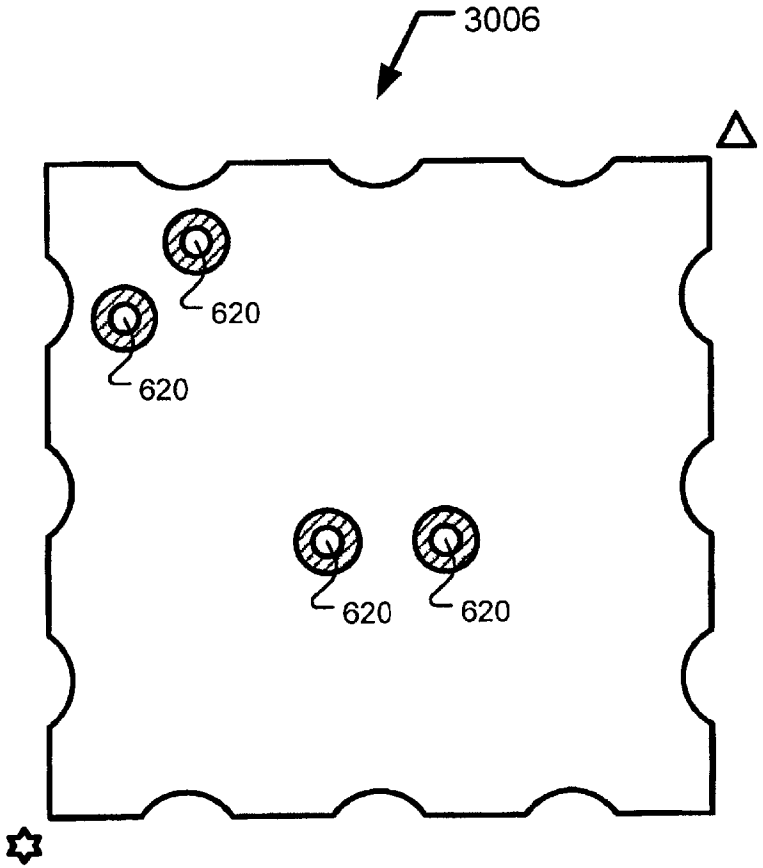
FIG. 39 shows conductive pads on, and conductive vias through, surface 3006.
Figure 38:
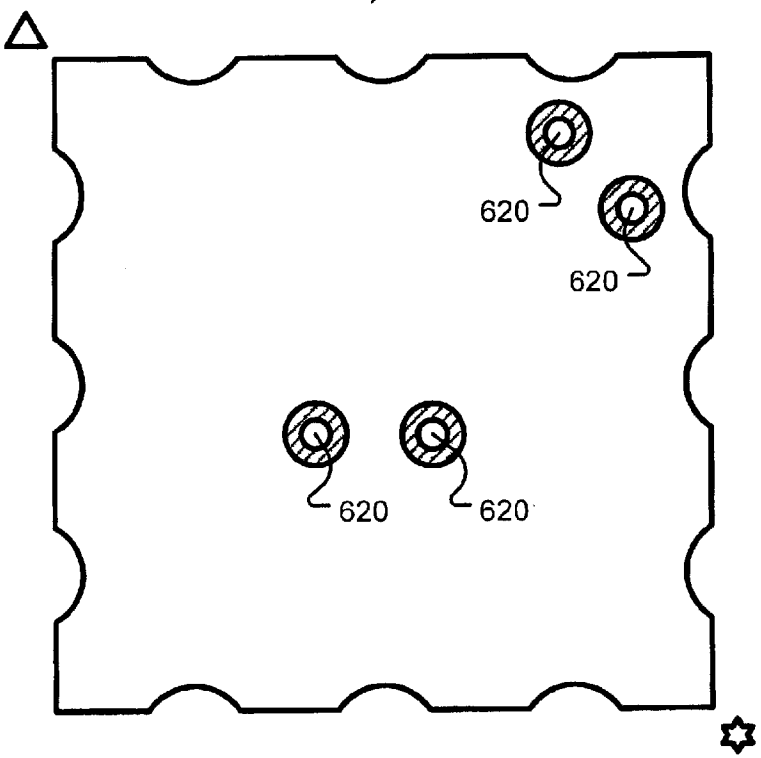
FIG. 38 shows conductive pads on, and conductive vias through, surface 3005.
Figures 40, 41:
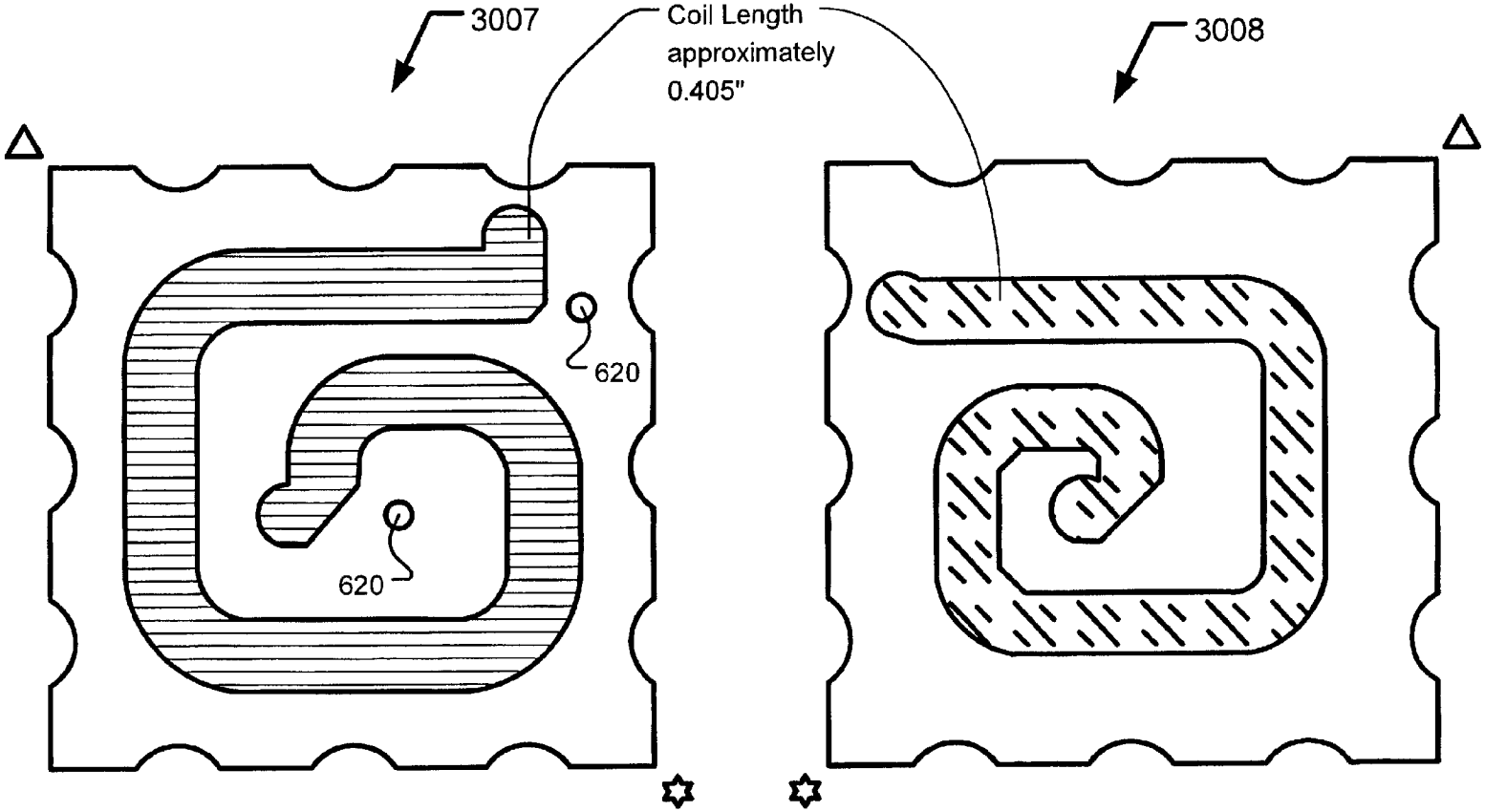
FIG. 40 shows metalization of a spiral coupling coil, and conductive vias through, surface 3007.
FIG. 41 shows a spiral coupling coil formed on surface 3008.
Figure 43:
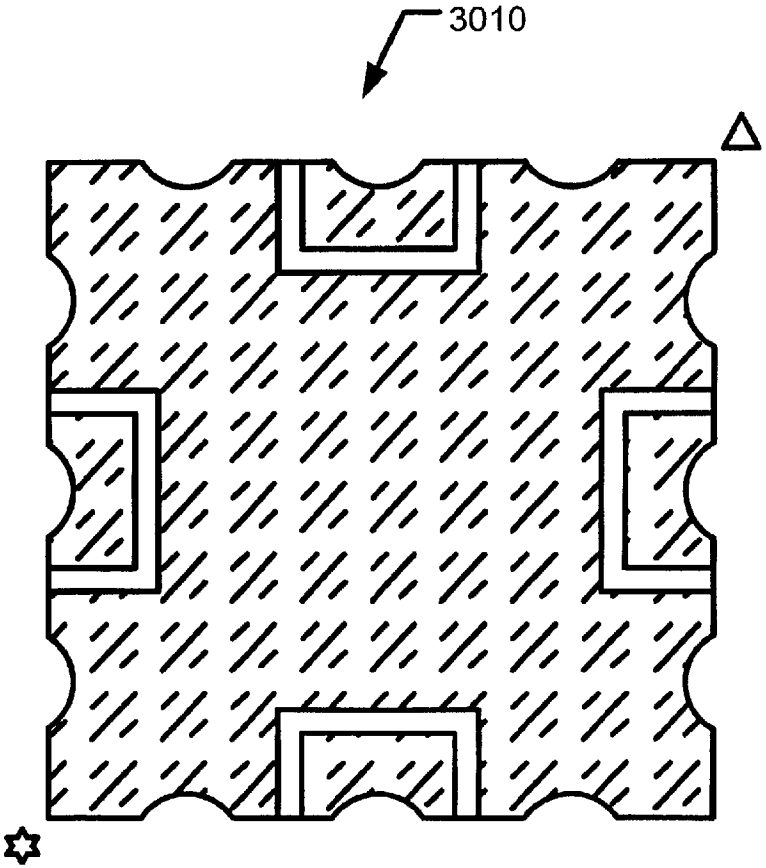
FIG. 43 shows metalization of surface 3010.
Figure 42:
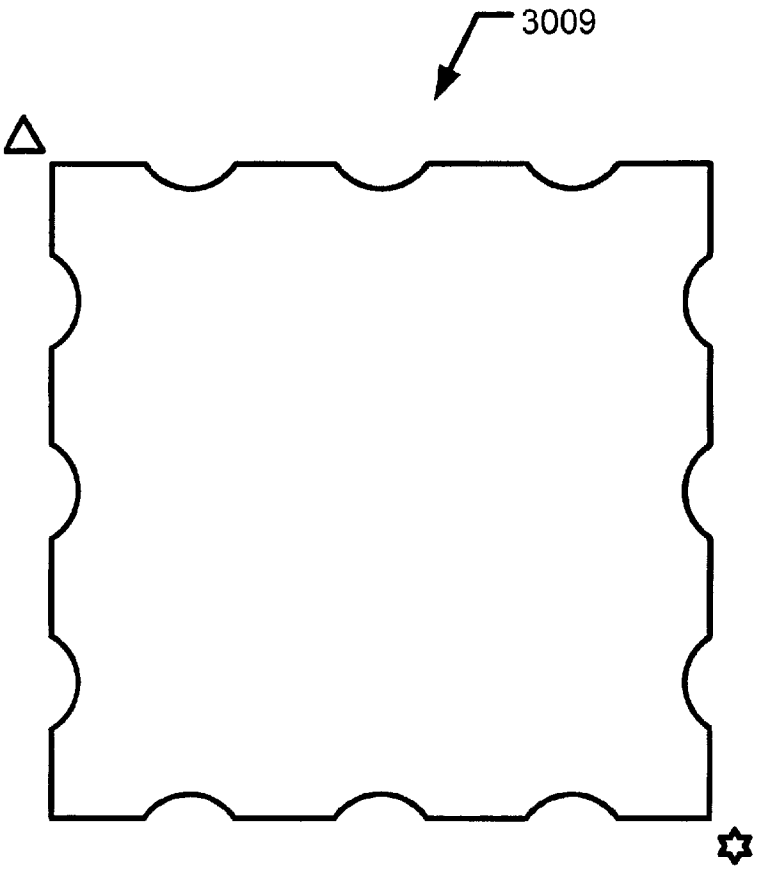
FIG. 42 shows surface 3009.

FIG. 33 shows a side view of the coupler 3000 consisting of dielectric substrate layers 1, 2, 3, 4, 5 which are approximately 0.175 inches square. Preferred thicknesses and dielectric constants (Er) for the layers 1–5 are shown in FIG. 33, though implementations may use different thickness and dielectric constant materials. Metalization, preferably ½ ounce copper, is disposed on layers 1, 2, 3, 4, 5 to provide some of the features of spiral coupler package 3000. For example, surfaces 3001, 3002; 3003, 3004; 3005, 3006; 3007, 3008; 3009, 3010 may be metalized as shown in corresponding FIGS. 34–43. As with package 300, thermal management considerations may effect the level of metalization used on layers 1, 2, 3, 4, 5, and thermal management may be accomplished through the addition of thermal conductors.

Metalization layers 3007 and 3008 are disposed between layer 3–4, and 4–5, respective. The layers 3007 (FIG. 40), and 3008 (FIG. 41) provide spiral-like coupling coils which are separated by dielectric layer 4. Via holes 620 provide signal pathways to the conductive metal interconnects shown on surface 3002 which, in turn, provide signal coupling through via holes to contact pads 3901–3904. The widths and lengths of the metal coupling lines shown on surfaces 3007, 3008 affect the performance of the coupler. In a preferred embodiment, the metal coupling lines of surfaces 3007–3008 are between approximately 0.004 and 0.011 inches wide and are approximately 0.405 inches in length. A groundplane, shown in FIG. 37, isolates the interconnects of FIG. 35 from the coupling lines of FIGS. 40–41 to reduce signal cross-talk would occur between the metalization lines of surface 3002 and those of surfaces 3007–3008.

A Preferred Method of Manufacturing Spiral Couplers

In a preferred embodiment a spiral coupler is fabricated in a multilayer structure comprising soft substrate PTFE laminates. Alternatively, a spiral coupler as described herein can be fabricated from glass based materials, ceramics or combinations of these materials. A process for constructing such a multilayer structure is disclosed by U.S. Pat. No. 6,099,677 to Logothetis et al., entitled "Method of Making Microwave, Multifunction Modules Using Fluoropolymer Composite Substrates", incorporated herein by reference.

Spiral couplers that are manufactured using fusion bonding technology advantageously avoid utilizing bonding films, which typically have low dielectric constants and hamper the degree to which spiral-like couplers can be miniaturized. The mismatch in dielectric constants between bonding film and the dielectric material prevents the creation of a homogeneous medium, since bonding films typically have dielectric constants in the range of approximately 2.5 to 3.5.

When miniaturization is desired for lower-frequency microwave applications, a dielectric constant of approximately 10 or higher is preferred for the dielectric material. In these applications, when bonding film is used as an adhesive, it tends to make the effective dielectric constant lower (i.e., lower than approximately 10) and not load the structure effectively. Additionally, the use of bonding film increases the tendency of undesired parasitic modes to propagate.

Figure 18:
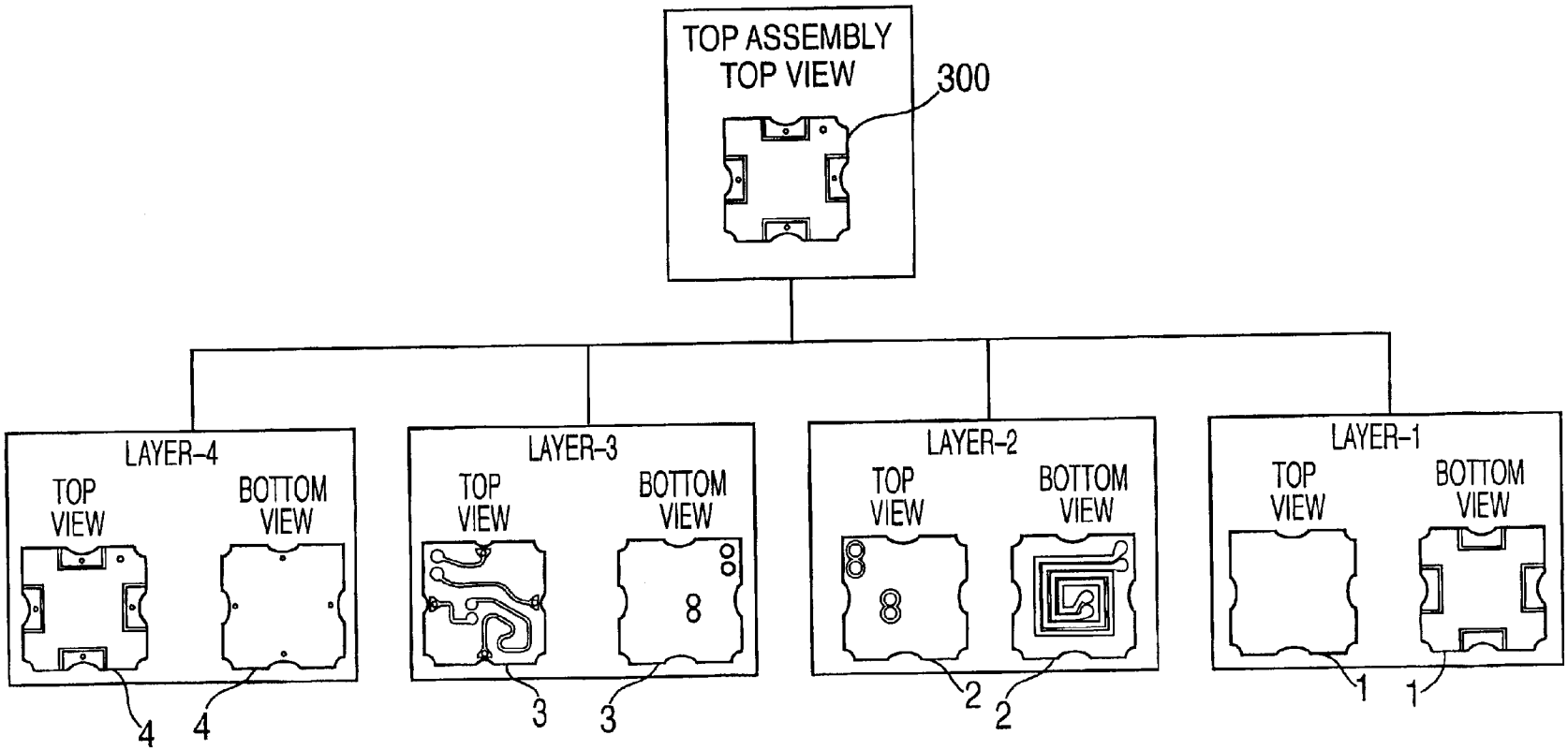
FIG. 18 is a schematic diagram showing an overview of the layers comprising the spiral coupler package of FIG. 3.
Figure 19B:
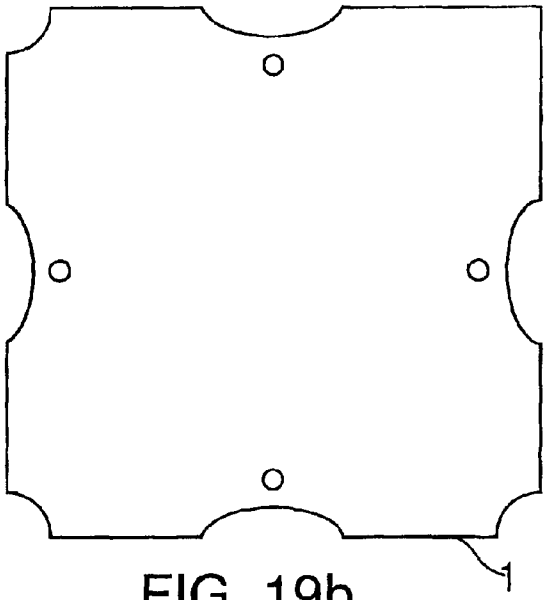
FIG. 19*b* is a bottom view of the fourth layer of the spiral coupler package of FIG. 3.
Figure 19A:
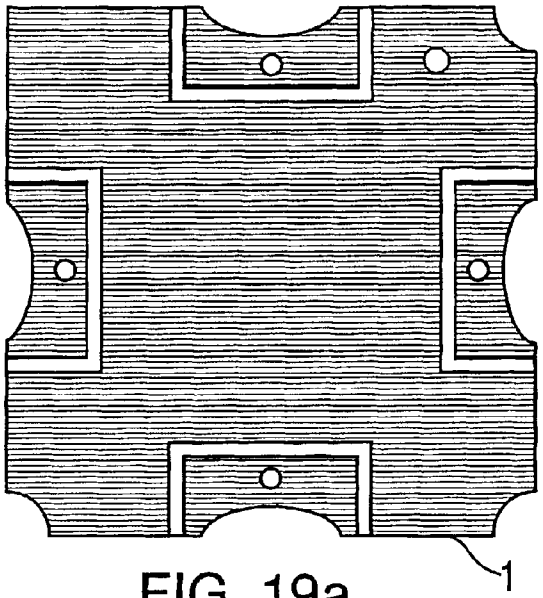
FIG. 19*a* is a top view of the fourth layer of the spiral coupler package of FIG. 3.
Figure 19C:
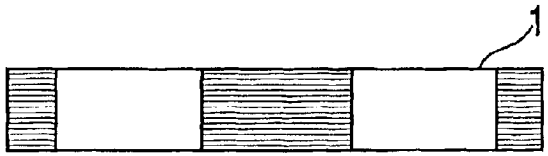
FIG. 19*c* is a side view of the fourth layer of the spiral coupler package of FIG. 3.
Figure 20B:
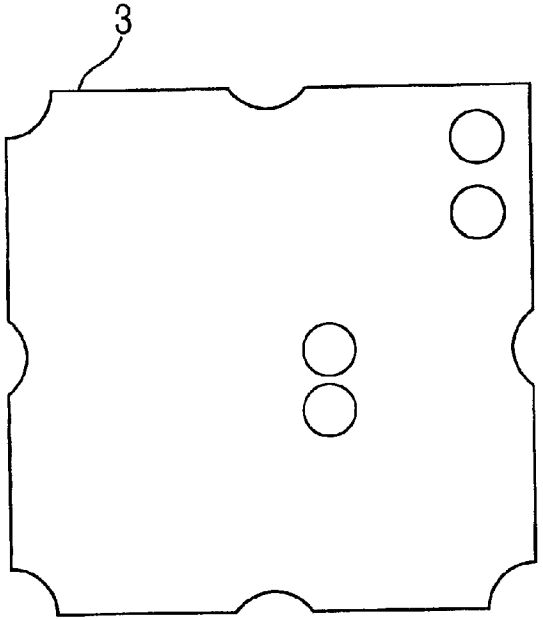
FIG. 20*b* is a bottom view of the third layer of the spiral coupler package of FIG. 3.
Figure 20A:
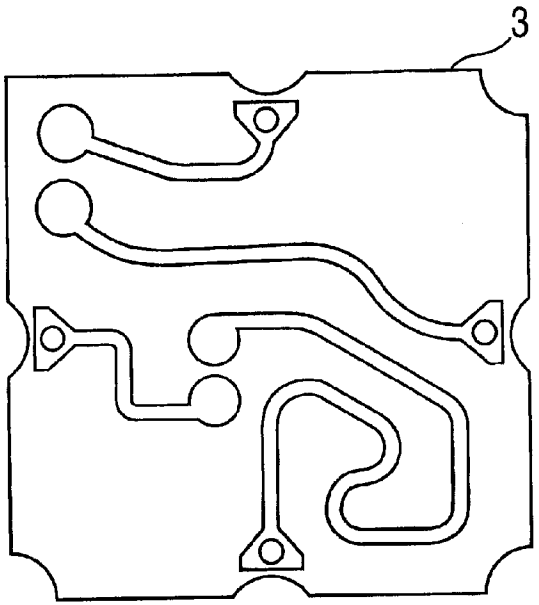
FIG. 20*a* is a top view of the third layer of the spiral coupler package of FIG. 3.
Figure 20C:
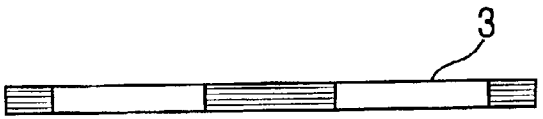
FIG. 20*c* is a side view of the third layer of the spiral coupler package of FIG. 3.
Figure 21B:
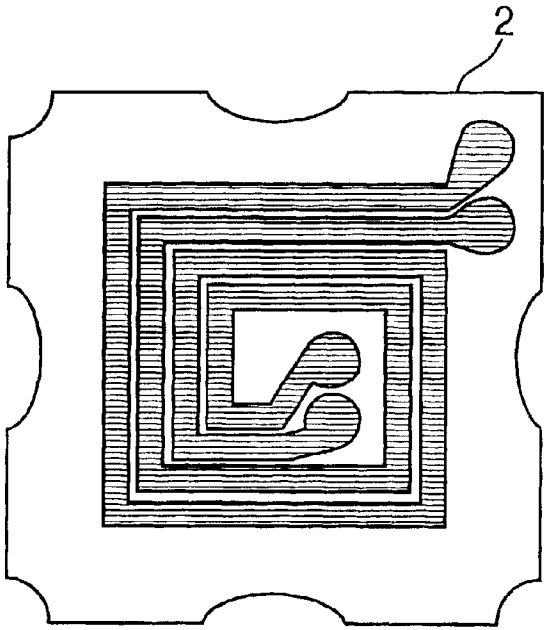
FIG. 21*b* is a bottom view of the second layer of the spiral coupler package of FIG. 3.
Figure 21A:
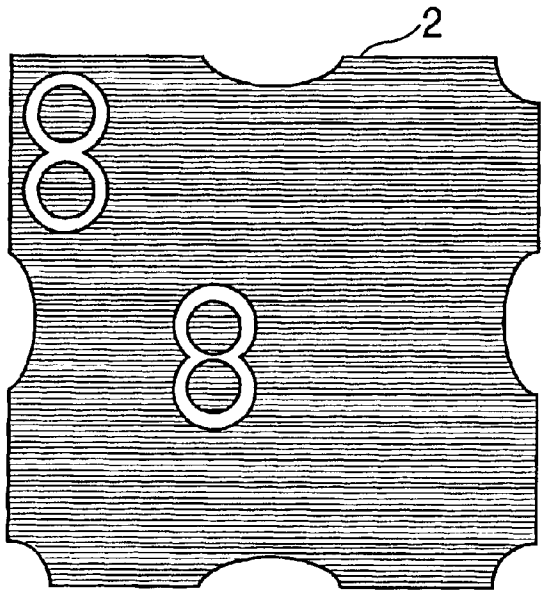
FIG. 21*a* is a top view of the second layer of the spiral coupler package of FIG. 3.
Figure 21C:
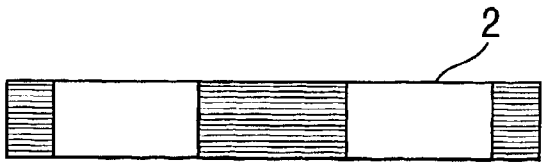
FIG. 21*c* is a side view of the second layer of the spiral coupler package of FIG. 3.
Figure 22B:
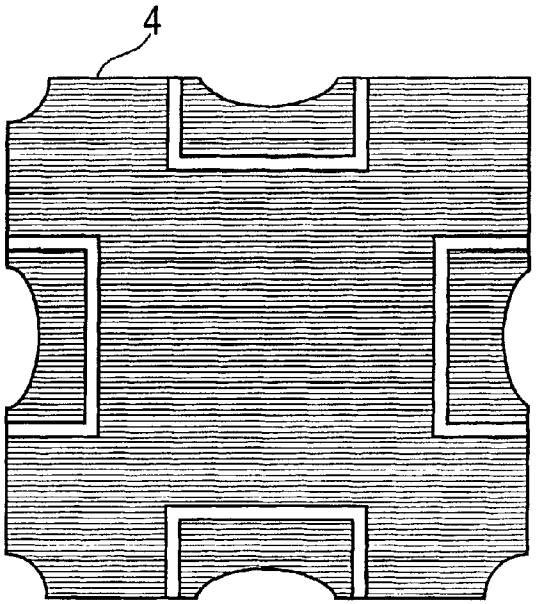
FIG. 22*b* is a bottom view of the first layer of the spiral coupler package of FIG. 3.
Figure 22A:
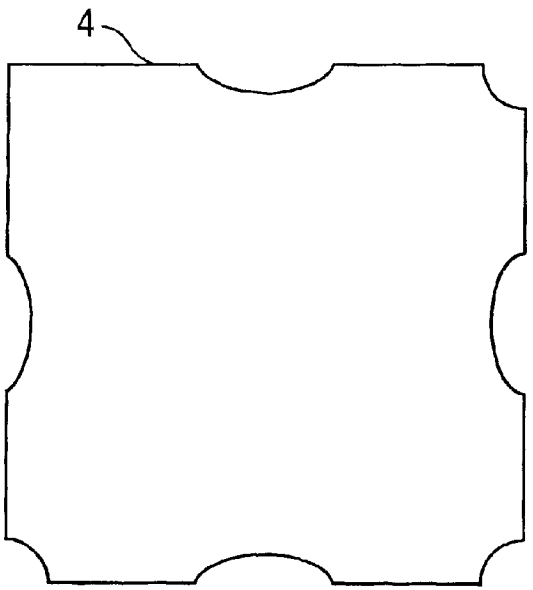
FIG. 22*a* is a top view of the first layer of the spiral coupler package of FIG. 3.
Figure 22C:
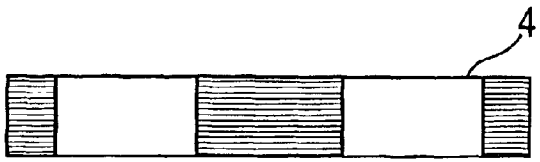
FIG. 22*c* is a side view of the first layer of the spiral coupler package of FIG. 3.

In a preferred embodiment, a spiral-like coupler package is created by fusion bonding layers 1, 2, 3, 4, having metalization patterns shown in FIG. 18, which are shown in greater detail in FIGS. 19*a*, 19*b*, 19*c*, 20*a*, 20*b*, 20*c*, 21*a*, 21*b*, 21*c*, 22*a*, 22*b*, 22*c*. The process by which this may be accomplished is described in greater detail below. This process may be similarly applied to form the package 3000 as shown in FIGS. 31–43.

Figure 23:
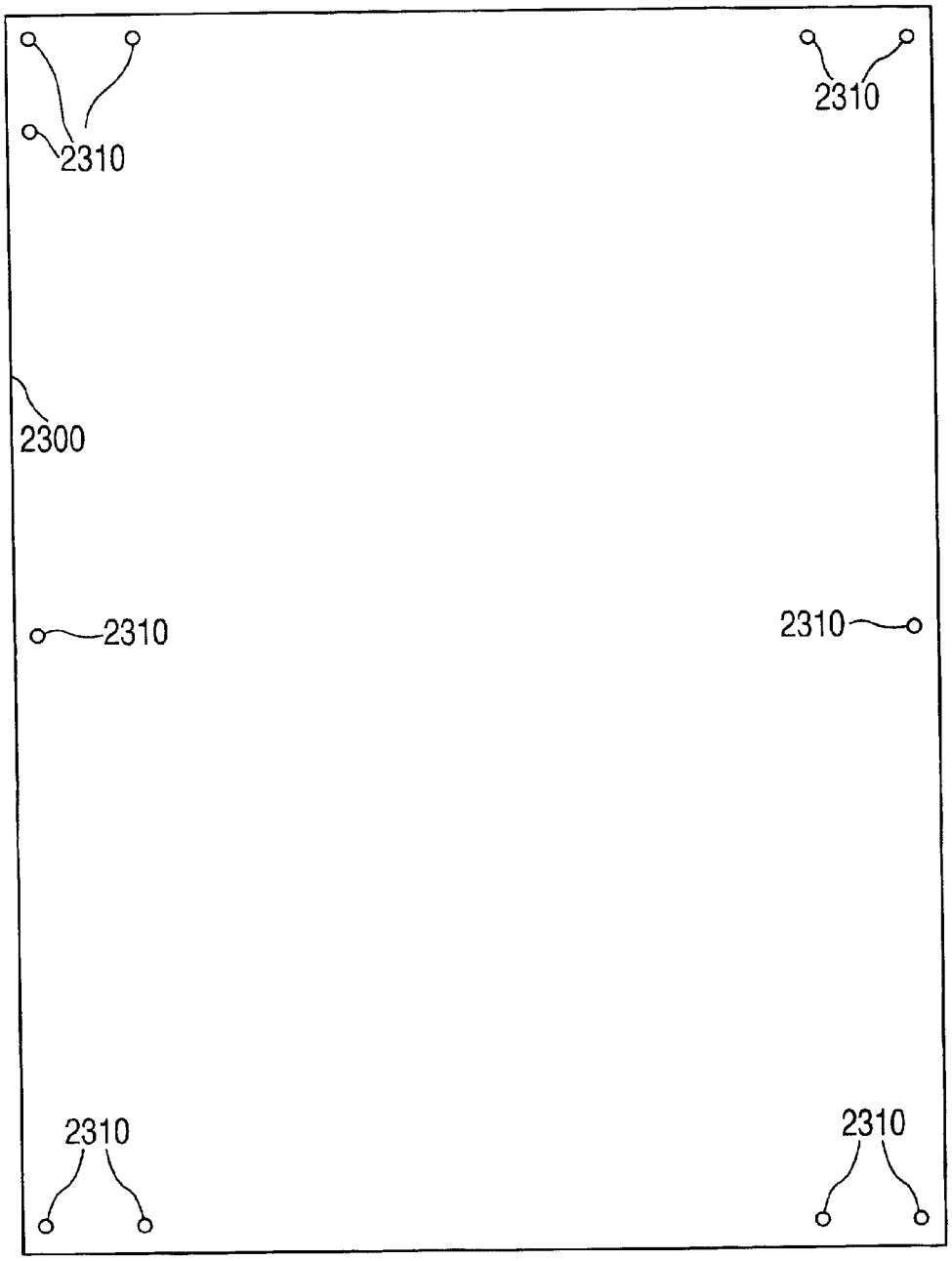
FIG. 23 is a substrate panel with alignment holes.

In a preferred embodiment, four fluoropolymer composite substrate panels, such as panel 2300 shown in FIG. 23, typically 9 inches by 12 inches, are mounted drilled with a rectangular or triangular alignment hole pattern. For example, alignment holes 2310, each of which has a diameter of 0.125 inches in a preferred embodiment, are drilled in the pattern shown in FIG. 23. Alignment holes 2310 are used to align panel 2300, or a stack of panels 2300.

An example of a preferred embodiment of panel 2300 is panel 2301 (not shown separately), which is approximately 0.025 inches thick and has a dielectric constant of approximately 10.2.

Figure 24:
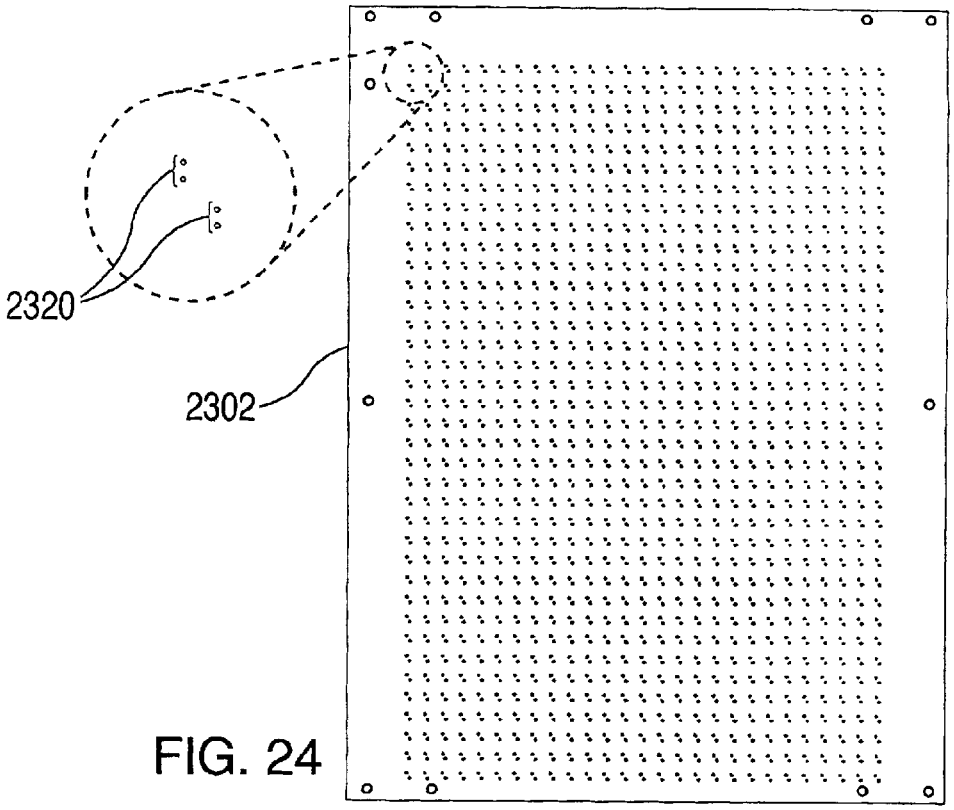
FIG. 24 is a substrate panel with alignment holes and holes for vias.

A second example of a preferred embodiment of panel 2300 is panel 2302, which is approximately 0.025 inches thick and has a dielectric constant of approximately 10.2. Holes 2320 having diameters of approximately 0.005 inches to 0.020 inches, but preferably having diameters of 0.008 inches, are drilled in the pattern shown in FIG. 24. Preferably, alignment holes 2310 and holes 2320 are drilled into panel 2302 before it is dismounted.

Figure 25:
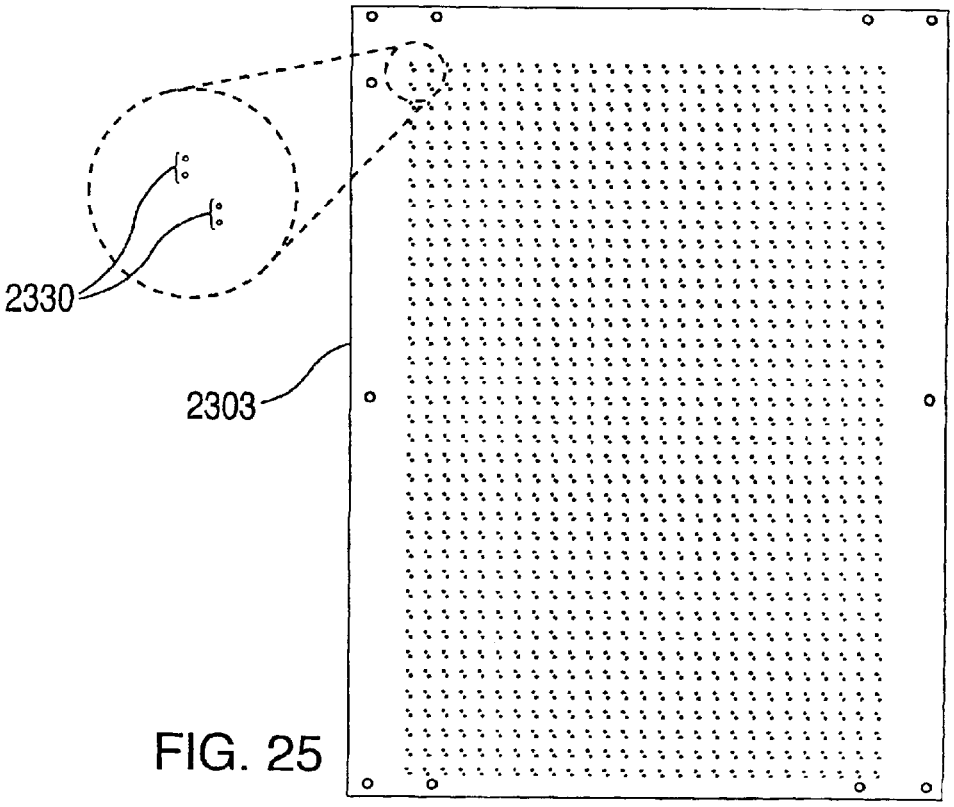
FIG. 25 is another substrate panel with alignment holes and holes for vias.

A third example of a preferred embodiment of panel 2300 is panel 2303, which is approximately 0.005 inches thick and has a dielectric constant of approximately 3.0. Holes 2330 having diameters of approximately 0.005 inches to 0.020 inches, but preferably having diameters of 0.008 inches, are drilled in the pattern shown in FIG. 25. Preferably, alignment holes 2310 and holes 2330 are drilled into panel 2303 before it is dismounted.

A fourth example of a preferred embodiment of panel 2300 is panel 2304 (not shown separately), which is approximately 0.005 inches thick and has a dielectric constant of approximately 3.0.

Holes 2320 of panel 2302 and holes 2330 of panel 2303 are plated through for via hole formation.

Figure 26A:
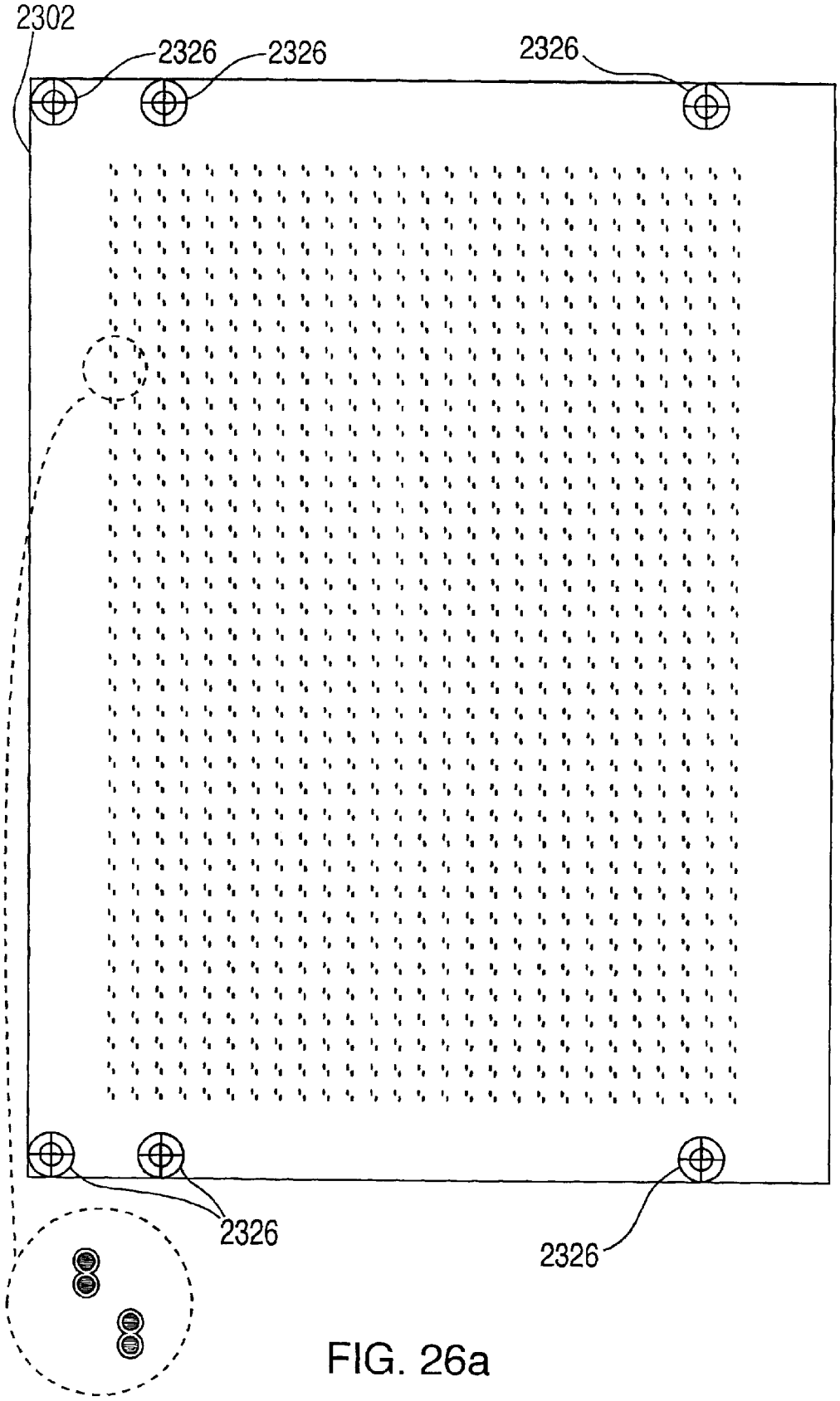
FIG. 26*a* is the top view of the substrate panel of FIG. 24 with a pattern etched out of copper.
Figure 26B:
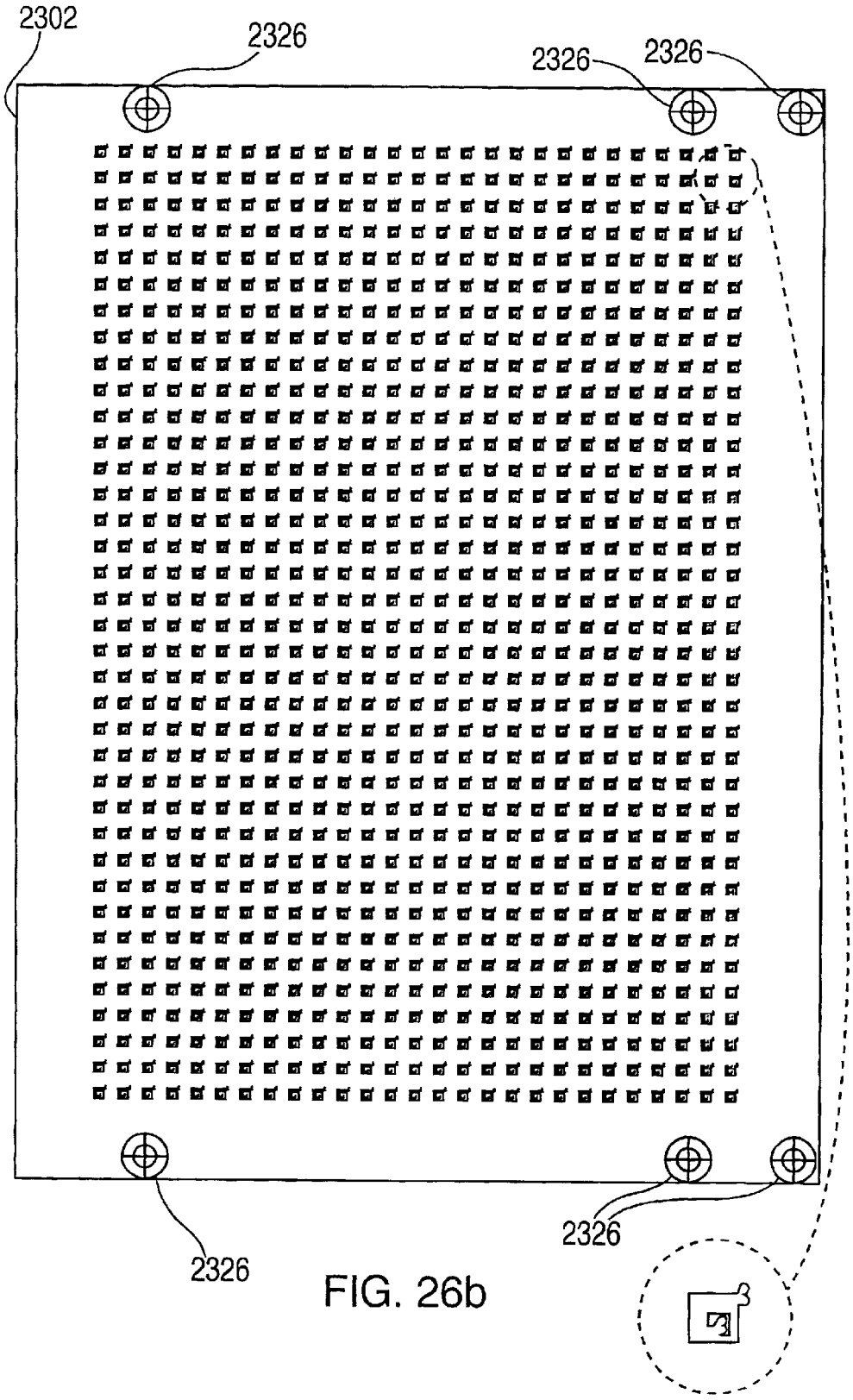
FIG. 26*b* is the bottom view of the substrate panel of FIG. 24 with a pattern etched out of copper.

Panel 2302 is further processed as follows. Panel 2302 is plasma or sodium etched, then cleaned by rinsing in alcohol for 15 to 30 minutes, then preferably rinsing in water, preferably deionized, having a temperature of 21 to 52 degrees C. for at least 15 minutes. Panel 2302 is then vacuum baked for approximately 30 minutes to 2 hours at approximately 90 to 180 degrees C., but preferably for one hour at 149 degrees C. Panel 2302 is plated with copper, preferably first using an electroless method followed by an electrolytic method, to a thickness of approximately 13 to 25 microns. Panel 2302 is preferably rinsed in water, preferably deionized, for at least 1 minute. Panel 2302 is heated to a temperature of approximately 90 to 125 degrees C. for approximately 5 to 30 minutes, but preferably 90 degrees C. for 5 minutes, and then laminated with photoresist. Masks are used and the photoresist is developed using the proper exposure settings to create the pattern shown in FIGS. 26A and 26B (shown in greater detail in FIG. 21A, where in a preferred embodiment rings having an inner diameter of approximately 0.013 inches and an outer diameter of at least 0.015 inches are etched out of the copper, and FIG. 21B). These patterns also preferably include at least six targets 2326 on either side of panel 2302. The targets 2326 can be used for drill alignment for future processing steps, and in a preferred embodiment comprise 0.040 inch annular rings around 0.020 inch etched circles. Both the top side and the bottom side of panel 2302 are copper etched. These patterns can also be defined using an additive plating process where the bare fluoropolymer substrate is metalized by using a sputtering or plating process. Panel 2302 is cleaned by rinsing in alcohol for 15 to 30 minutes, then preferably rinsing in water, preferably deionized, having a temperature of 21 to 52 degrees C. for at least 15 minutes. Panel 2302 is then vacuum baked for approximately 30 minutes to 2 hours at approximately 90 to 180 degrees C., but preferably for one hour at 149 degrees C.

Figure 27A:
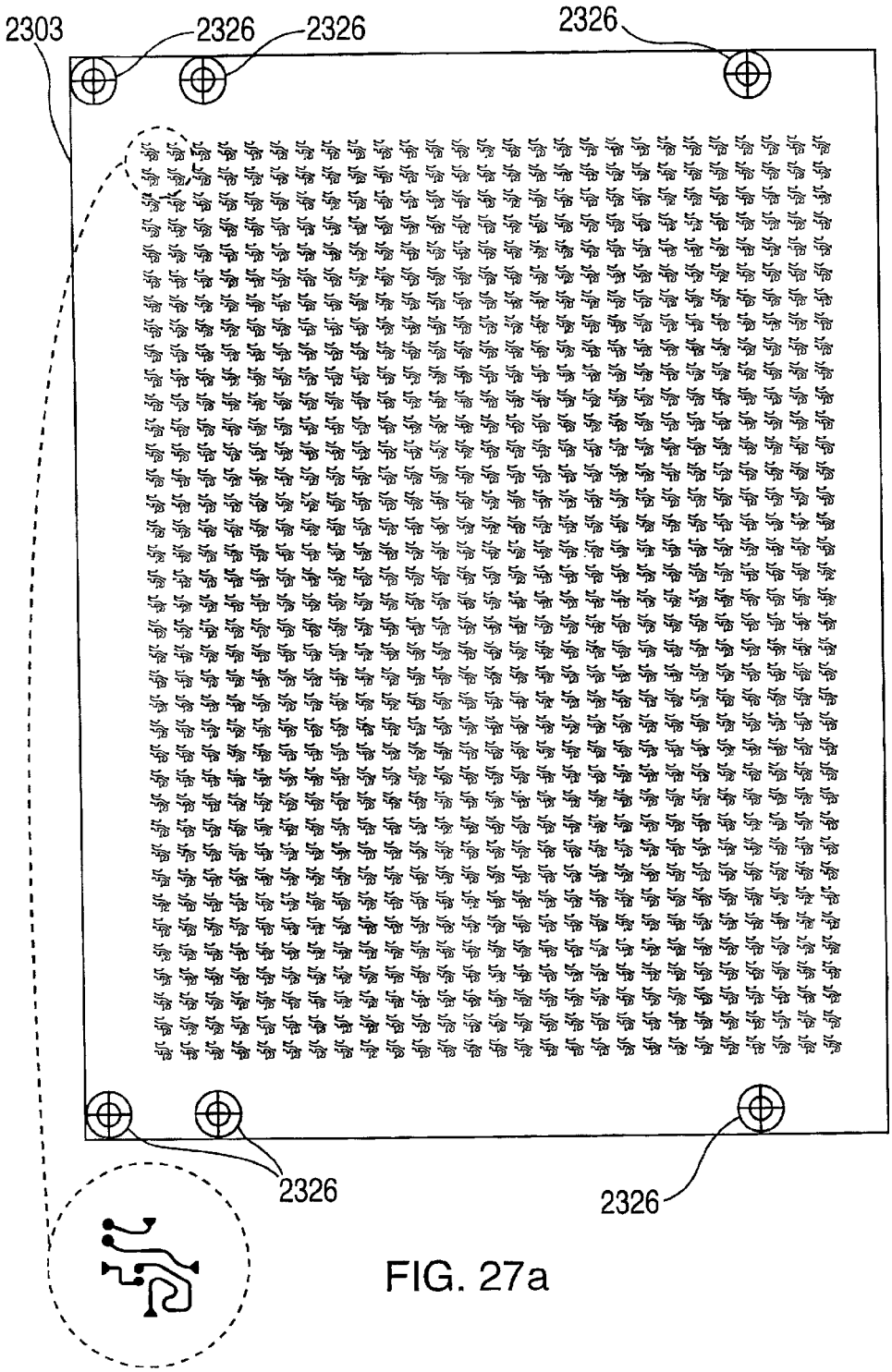
FIG. 27*a* is the top view of the substrate panel of FIG. 25 with a pattern etched out of copper.
Figure 27B:
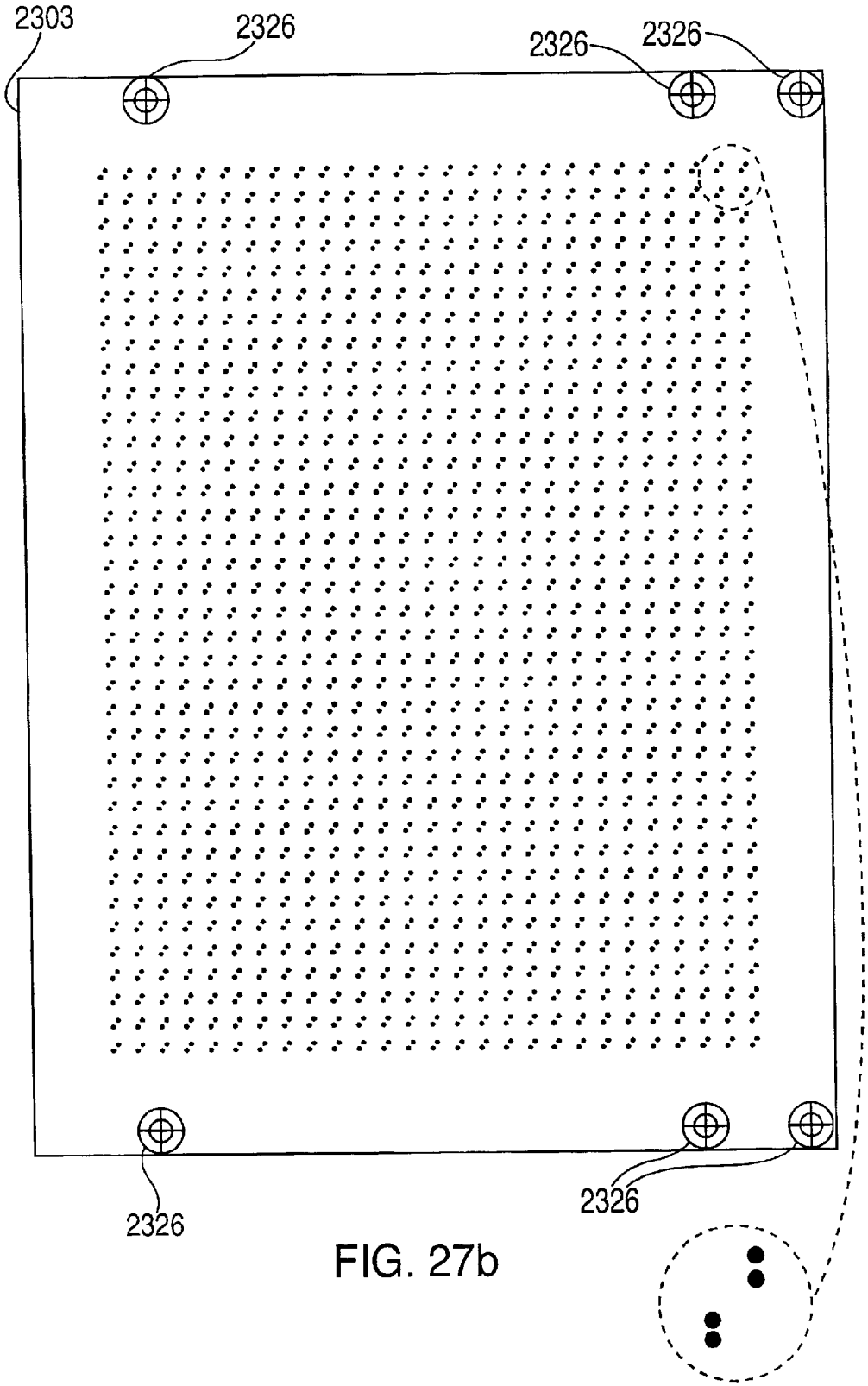
FIG. 27*b* is the bottom view of the substrate panel of FIG. 25 with a pattern etched out of copper.

Panel 2303 is further processed as follows. Panel 2303 is plasma or sodium etched, then cleaned by rinsing in alcohol for 15 to 30 minutes, then preferably rinsing in water, preferably deionized, having a temperature of 21 to 52 degrees C. for at least 15 minutes. Panel 2303 is then vacuum baked for approximately 30 minutes to 2 hours at approximately 90 to 180 degrees C., but preferably for one hour at 149 degrees C. Panel 2303 is plated with copper, preferably first using an electroless method followed by an electrolytic method, to a thickness of approximately 13 to 25 microns. Panel 2303 is preferably rinsed in water, preferably deionized, for at least 1 minute. Panel 2303 is heated to a temperature of approximately 90 to 125 degrees C. for approximately 5 to 30 minutes, but preferably 90 degrees C. for 5 minutes, and then laminated with photoresist. Masks are used and the photoresist is developed using the proper exposure settings to create the pattern shown in FIGS. 27A and 27B (shown in greater detail in FIGS. 20A and 20B). These patterns also preferably include at least six targets 2326 on either side of panel 2303. The targets 2326 can be used for drill alignment for future processing steps, and in a preferred embodiment comprise 0.040 inch annular rings around 0.020 inch etched circles. Both the top side and the bottom side of panel 2303 are copper etched. Panel 2303 is cleaned by rinsing in alcohol for 15 to 30 minutes, then preferably rinsing in water, preferably deionized, having a temperature of 21 to 52 degrees C. for at least 15 minutes. Panel 2303 is then vacuum baked for approximately 30 minutes to 2 hours at approximately 90 to 180 degrees C., but preferably for one hour at 149 degrees C.

With the assistance of targets 2326 and alignment holes 2310, panels 2304, 2303, 2302, 2300 are stacked aligned and fusion bonded into assembly 2800 (FIG. 28), in a preferred embodiment, at a pressure of 200 PSI, with a 40 minute ramp from room temperature to 240 degrees C., a 45 minute ramp to 375 degrees C., a 15 minutes dwell at 375 degrees C., and a 90 minute ramp to 35 degrees C.

Assembly 2800 is then aligned for the depaneling process. In a preferred embodiment, alignment is accomplished as follows. An attempt is made to drill at least two secondary alignment holes, 0.020 inches in diameter, as close as possible to the center of two of targets 2326. Using an X-ray source, the proximity of the alignment holes to the actual targets 2326 is determined. The relative position of the drill to assembly 2800 is then adjusted and another attempt to hit the center of targets 2326 is made. The process is repeated, and additional targets 2326 are used if necessary, until proper alignment is achieved. Finally, four new alignment holes, each having a diameter of 0.125 inches, are drilled so that assembly 2800 can be properly mounted.

Figure 28:
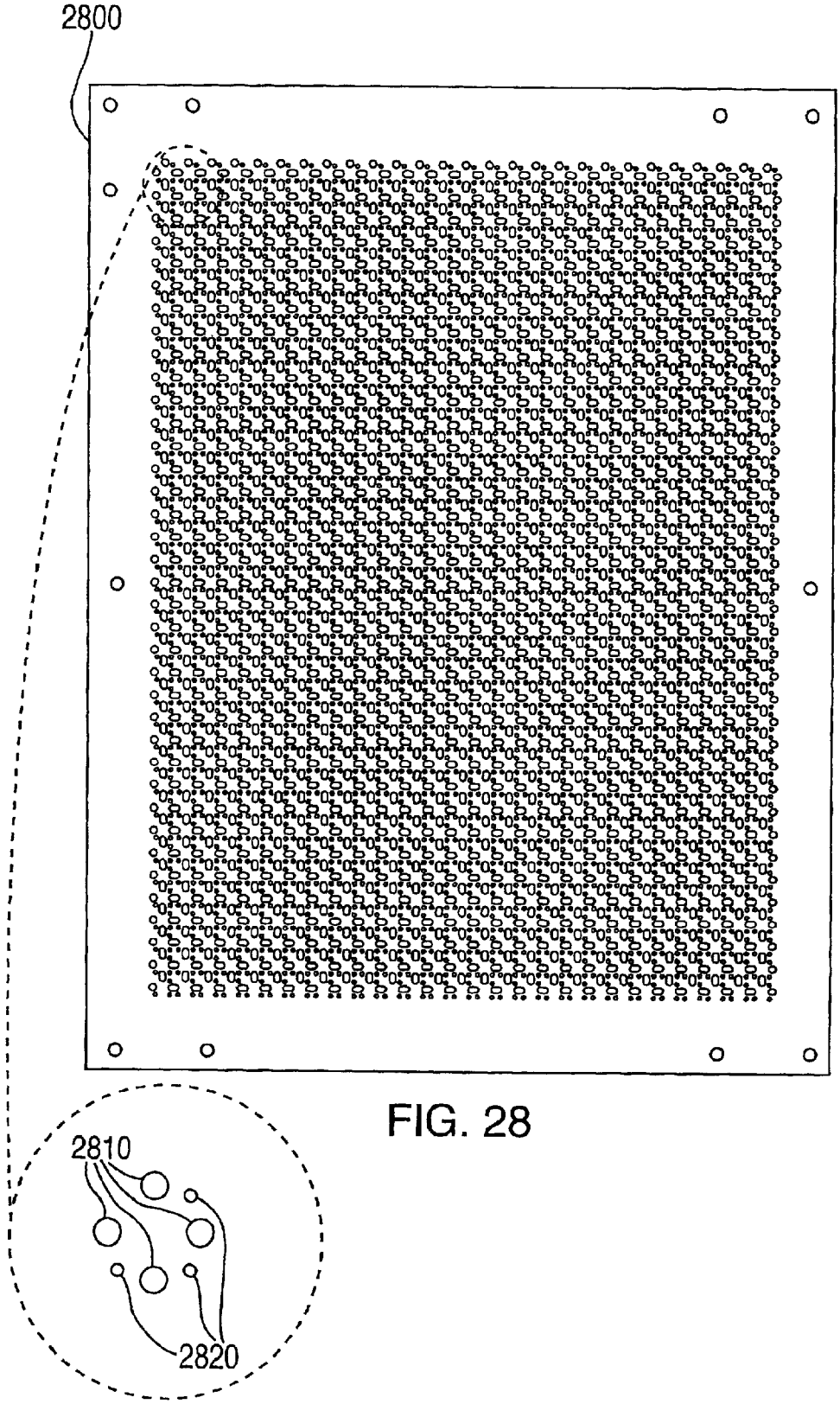
FIG. 28 is the top view of an assembly of four fusion-bonded panels with drilled holes.
Figure 29:
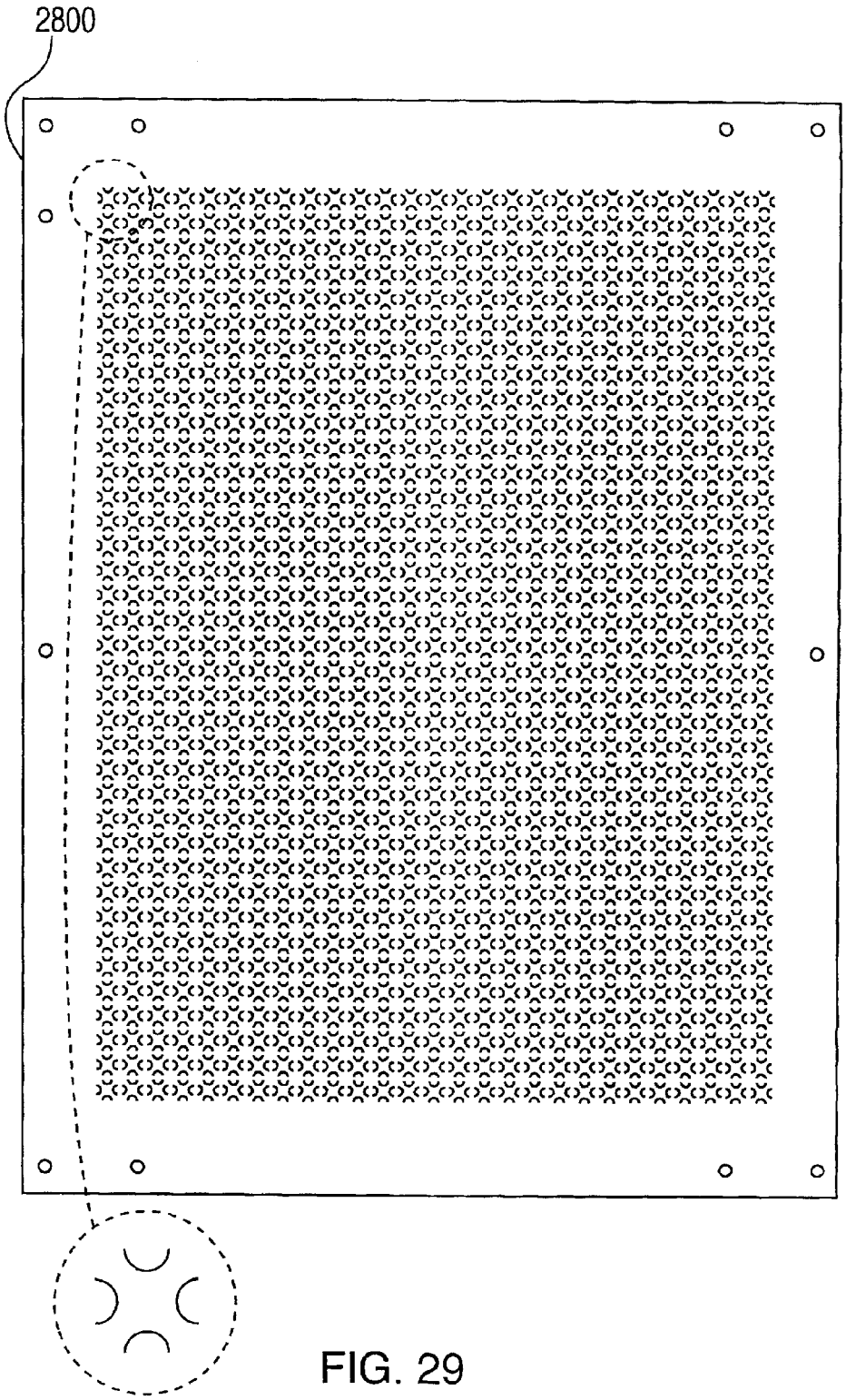
FIG. 29 shows a pattern etched out of copper on the top and bottom of the assembly of FIG. 28.

With reference to FIG. 28, in a preferred embodiment holes 2810 having diameters of approximately 0.070 inches and holes 2820 having diameters of approximately 0.039 inches are drilled in the pattern shown. Assembly 2800 is plasma or sodium etched. Assembly 2800 is cleaned by rinsing in alcohol for 15 to 30 minutes, then preferably rinsing in water, preferably deionized, having a temperature of 21 to 52 degrees C. for at least 15 minutes. Assembly 2800 is then vacuum baked for approximately 30 minutes to 2 hours at approximately 90 to 180 degrees C., but preferably for one hour at 100 degrees C. Assembly 2800 is plated with copper, preferably first using an electroless method followed by an electrolytic method, to a thickness of approximately 13 to 25 microns. Assembly 2800 is preferably rinsed in water, preferably deionized, for at least 1 minute. Assembly 2800 is heated to a temperature of approximately 90 to 125 degrees C. for approximately 5 to 30 minutes, but preferably 90 degrees C. for 5 minutes, and then laminated with photoresist. A mask is used and the photoresist is developed using the proper exposure settings to create the pattern shown in FIG. 29 (shown in greater detail in FIGS. 22A and 19B). Both the top side and bottom side of assembly 2800 is copper etched. Assembly 2800 is cleaned by rinsing in alcohol for 15 to 30 minutes, then preferably rinsing in water, preferably deionized, having a temperature of 21 to 52 degrees C. for at least 15 minutes. Assembly 2800 is plated with tin or lead, then the tin/lead plating is heated to the melting point to allow excess plating to reflow into a solder alloy. Assembly 2800 is again cleaned by rinsing in alcohol for 15 to 30 minutes, then preferably rinsing in water, preferably deionized, having a temperature of 21 to 52 degrees C. for at least 15 minutes.

Figure 30:
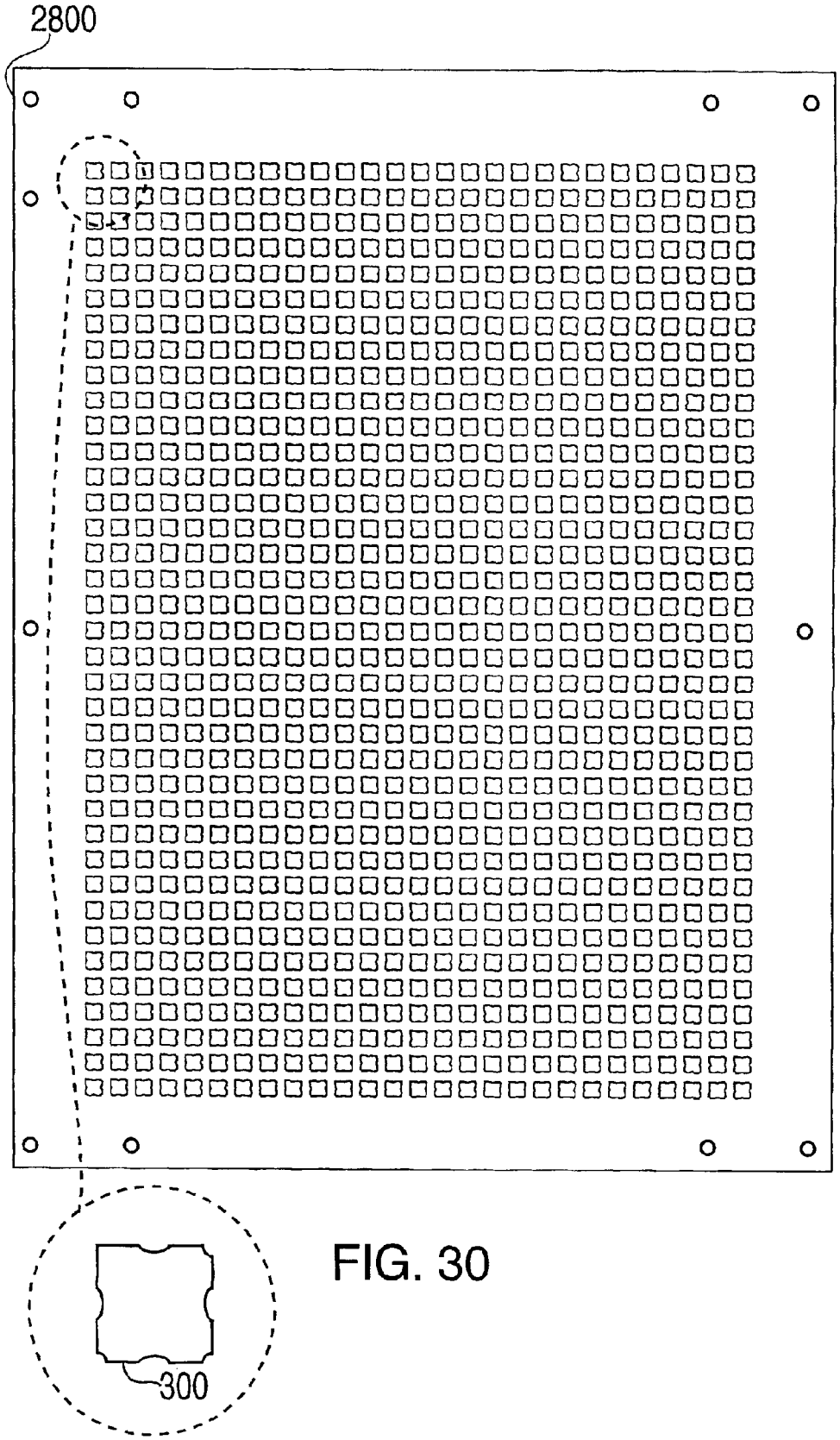
FIG. 30 is the top view of an array of the spiral coupler package of FIG. 3.

Assembly 2800 is depaneled, as shown in FIG. 30, using a depaneling method, which may include drilling and milling, diamond saw, and/or EXCIMER laser. In a preferred embodiment, tacky tape, such as 0.003 inches thick tacky tape in a preferred embodiment, is used to remove the individual spiral coupler packages 300. A manufacturer of such tacky tape is Minnesota Mining and Manufacturing Co. ("3M"), located in St. Paul, Minn. Assembly 2800 is again cleaned by rinsing in alcohol for 15 to 30 minutes, then preferably rinsing in water, preferably deionized, having a temperature of 21 to 52 degrees C. for at least 15 minutes. Assembly 2800 is then vacuum baked for approximately 45 to 90 minutes at approximately 90 to 125 degrees C., but preferably for one hour at 100 degrees C.

Combining Spiral-Like Couplers with Other Components

Spiral-like couplers utilizing PTFE can be used in conjunction with other components and other technologies. For example, ceramic materials (having their own circuitry) can be attached to PTFE, by means of film bonding, or glue, by way of example only. Hybrid circuits combining the benefits of ceramics and PTFE can have benefits over either technology alone. For example, the relatively high dielectric constants, e.g. above approximately 10.2, of hard ceramics in a hybrid circuit can allow a manufacturer to design a circuit that is smaller and less lossy than pure PTFE circuits. Ceramics inserted within a cavity of a PTFE structure as a drop-in unit allows the exploitation of both ceramic and PTFE processes. Since hard ceramics typically offer very low loss tangents, the resulting circuits are less lossy.

A manufacturer can also embed within such a circuit ferrite and/or ferroelectric materials with the same consistency of ceramics. Ferroelectic materials have variable dielectric constant charges that can be controlled with a DC bias voltage. Thus, the frequency range of a coupler can be tuned electronically by changing the dielectric loading. Although ferrite materials may not offer much benefit to traditional couplers, they can be beneficial for spiral-like couplers, whose frequency ranges can be more beneficially varied.

Using PTFE, one can embed active elements in a fusion bonded homogeneous dielectric structure, in conjunction with spiral-like couplers. Some applications for combining active elements with spiral-like couplers include, by way of example only, digital attenuators, tunable phase shifters, IQ networks, vector modulators, and active mixers.

Advantages and Applications of Mixing Dielectric Constants

A benefit of mixing PTFE material having different dielectric constants in a microwave device is the ability to achieve a desired dielectric constant between approximately 2.2 to 10.2. This is achieved by mixing and weighting different materials and thicknesses in a predetermined stack arrangement. Some advantages of this method are: design freedom to vary dimensional properties associated with a particular pre-existing design; providing a stack-up of multiconductor-coupled lines in the z-plane; and creating a broader range of coupling values. By varying the thickness of layers (whose other attributes may be predefined), one can vary the properties of spiral couplers without extensive redesign.

While there have been shown and described and pointed out fundamental novel features of the invention as applied to embodiments thereof, it will be understood that various omissions and substitutions and changes in the form and details of the invention, as herein disclosed, may be made by those skilled in the art without departing from the spirit of the invention. It is expressly intended that all combinations of those elements and/or method steps which perform substantially the same function in substantially the same way to achieve the same results are within the scope of the invention. It is the intention, therefore, to be limited only as indicated by the scope of the claims appended hereto.

What is claimed is:

1. A microwave coupler comprising:

a sandwiched plurality of dielectric substrate layers, said plurality of layers comprising a first dielectric layer having a first and a second planar surface;

a first coupling line comprising a spiral winding that is positioned adjacent the first planar surface;

a second coupling line comprising a spiral winding that is positioned adjacent the second planar surface to effect electromagnetic coupling with the spiral winding of the first coupling line;

a plurality of groundplanes positioned at other planar surfaces between ones of the other dielectric layers to effect signal isolation of the first and second coupling lines; and a first pair of conductive vias passing from an exterior surface of the coupler through at leant one of the dielectric layers to the first coupling line and a second pair of conductive vias passing from an exterior surface of the coupler through at least one of the dielectric layers to the second coupling line, said first and second pair of conductive via comprising a same material composition as comprises said conducting lines and providing for signal coupling to signal paths external to the microwave coupler.

2. The coupler of claim 1 wherein the substrate layers are comprised of a fluoropolymer composite.

3. The microwave circuit of claim 2, wherein said plurality of fluoropolymer composite substrate layers are fusion bonded into a homogeneous dielectric structure.

4. The microwave circuit of claim 3 wherein at least one of said plurality of fluoropolymer composite substrate layers is adhered to ceramic.

5. A method of manufacturing a microwave coupler comprising the steps of:

forming a fused structure of dielectric layers comprising a first dielectric layer sandwiched between a second and third dielectric layers, a first coupling line comprising a spiral winding formed at a planar surface between the first and second layers and a second coupling line comprising a spiral winding formed at a second planar surface between the first and third layer;

forming a plurality of groundplanes bounding said fused structure of dielectric layers to provide for signal isolation of the first and second coupling lines; and forming a first pair of conductive vias passing from an exterior surface of the coupler through the second layer to the first coupling line and a second pair of conductive vias passing from an exterior surface of the coupler through at least one of the dielectric layers to the second coupling line, said first and second pair of conductive vias comprising a same material composition as comprises said coupler and providing for signal coupling to signal paths external to the microwave coupler.

6. The method of claim 5 wherein said dielectric layers comprise fluoropolymer composite substrate layers fusion bonded into a homogeneous dielectric structure.

7. The method of manufacturing a coupler having a spiral-like shape of claim 6, wherein at least one of said plurality of fluoropolymer composite substrate layers is adhered to ceramic.

8. A microwave circuit package comprising:

a plurality of fluoropolymer composite substrate layers;

a plurality of metal layers disposed on said surfaces of the plurality of substrate layers;

a plurality of groundplanes comprising a first subset of said plurality of metal layers connected by a first plurality of conductors; and at least one coupler comprising a plurality of coupling lines each coupling line being located on a different plane and substantially co-planer with respect to others of the coupling lines, and each coupling line having a substantially spiral shape formed within its respective plane, and said ground planes being configured to enable coupling between a first line of the coupler on a first plane and a second line of the coupler on a second plane, wherein said plurality of fluoropolymer composite substrate layers are fusion bonded into a homogeneous dielectric structure and at least one of said plurality of fluoropolymer composite substrate layers is adhered to ceramic.

9. A microwave circuit comprising:

fluoropolymer composite substrate means for defining substrate layers and substrate layer surfaces; metal layer means disposed on said surfaces to define a plurality of conducting layers;

grounding means comprising a first subset of said plurality of conducting layers; and coupling lines means comprising a second subset of said plurality of conducting layers for forming a coupler having a substantially spiral-like shape and coupling coils distributed across a plurality of planes; and a conductive via comprising a same material composition as comprises said conducting layers, the conductive via interconnecting the coupling line means to a signal port terminal.

10. The microwave circuit of claim 9, wherein said coupling lines means are substantially co-planar.

11. The microwave circuit of claim 9, wherein said coupling lines means comprises at least three coupling lines.

12. The microwave circuit of claim 9, wherein at least one of said surfaces is adhered to ceramic.

* * * * *